US009648995B2

(12) United States Patent
Elliott et al.

(10) Patent No.: US 9,648,995 B2
(45) Date of Patent: May 16, 2017

(54) TISSUE DISPENSER AND METHOD FOR DISPENSING TISSUE

(71) Applicant: Wausau Paper Towel & Tissue, LLC, Mosinee, WI (US)

(72) Inventors: Adam Troy Elliott, Lexington, KY (US); Daniel James Knight, Lexington, KY (US)

(73) Assignee: Wausau Paper Towel & Tissue, LLC, Mosinee, WI (US)

( * ) Notice: Subject to any disclaimer, the term of this patent is extended or adjusted under 35 U.S.C. 154(b) by 399 days.

(21) Appl. No.: 14/484,976

(22) Filed: Sep. 12, 2014

(65) Prior Publication Data

US 2015/0076277 A1 Mar. 19, 2015

Related U.S. Application Data

(60) Provisional application No. 61/877,771, filed on Sep. 13, 2013.

(51) Int. Cl.
*A47K 10/38* (2006.01)
*A47K 10/32* (2006.01)

(52) U.S. Cl.
CPC .. *A47K 10/3836* (2013.01); *A47K 2010/3253* (2013.01)

(58) Field of Classification Search
CPC ..... A47K 10/3836; A47K 201/3253
See application file for complete search history.

(56) References Cited

U.S. PATENT DOCUMENTS 3,381,909 A 5/1968 Tucker et al.
4,872,601 A * 10/1989 Sigmund ..... A47K 10/3836 225/38

(Continued)

FOREIGN PATENT DOCUMENTS

DE 103 16 790 * 10/2004
EP 1 941 821 A1 7/2008
WO WO 2015/072948 * 5/2015

OTHER PUBLICATIONS

"Mini-Twin Porta-Roll Dispensers" VonDrehle. Web. Jul. 30, 2013. <www.vondrehle.com/default/index.cfm/product-catalog/dispensers/mini-twin-porta-roll-dispensers/.

(Continued)

*Primary Examiner* — William A Rivera
(74) *Attorney, Agent, or Firm* — Merchant & Gould, P.C.

(57) ABSTRACT

A tissue dispenser includes: (a) a housing and cover that attach together and form an interior region for holding multiple tissue rolls and a dispenser opening for dispensing tissue from the dispenser interior; (b) a first roll holder located within the interior region, the first roll holder comprising a first back panel and a first mandrel extending from the first back panel, the first back panel is constructed to rotate, relative to the housing, between a locked position and an unlocked position, and the first mandrel is constructed to receive a first tissue roll; (c) a second roll holder located within the interior region, the second roll holder comprising a second back panel and second mandrel extending from the second back panel, the second back panel is constructed to rotate relative to the housing, between a locked position and an unlocked position, and the second mandrel is constructed to receive a second tissue roll; and (d) a door constructed to move within the dispenser opening between a first position and a second position so that when the door is provided in the first position, tissue can be dispensed from the first tissue (Continued)

roll provided on the first mandrel, and when the door is provided in the second position, tissue can be dispensed from the second tissue roll positioned on the second mandrel, wherein the door is constructed so that when the door is provided in either the first position or the second position and tissue is dispensing from either the first roll or the second roll, then the door is unable to move to the other of the first position or the second position until the tissue being dispensed is exhausted. A method for dispensing tissue is provided.

21 Claims, 22 Drawing Sheets

(56) References Cited

U.S. PATENT DOCUMENTS

| | | | | |
|---|---|---|---|---|
| 5,265,816 | A * | 11/1993 | Collins | A47K 10/3836 242/560 |
| 5,645,244 | A * | 7/1997 | Moody | A47K 10/3809 242/422.5 |
| 5,813,624 | A | 9/1998 | Grasso et al. | |
| 6,202,956 | B1 | 3/2001 | Grasso et al. | |
| 6,439,502 | B1 | 8/2002 | Gemmell et al. | |
| 6,491,251 | B1 | 12/2002 | Stanland et al. | |
| 6,648,267 | B2 | 11/2003 | Stanland et al. | |
| 7,014,140 | B2 | 3/2006 | Elliott et al. | |
| 7,083,138 | B2 | 8/2006 | Elliott et al. | |
| 7,107,888 | B2 | 9/2006 | Blume et al. | |
| 7,114,676 | B2 | 10/2006 | Elliott et al. | |
| 7,127,974 | B2 | 10/2006 | Blume et al. | |
| 2004/0004152 | A1 * | 1/2004 | Kapiloff | A47K 10/3836 242/597.8 |
| 2004/0004153 | A1 * | 1/2004 | Kapiloff | A47K 10/3836 242/597.8 |
| 2005/0167543 | A1 * | 8/2005 | Elliott | A47K 10/38 242/596.8 |
| 2006/0038054 | A1 * | 2/2006 | Tramontina | A47K 10/38 242/560 |
| 2007/0290094 | A1 * | 12/2007 | Anderson | A47K 10/3836 242/594 |
| 2013/0026281 | A1 | 1/2013 | Knight et al. | |

OTHER PUBLICATIONS

"Twin Jumbo Roll Dispenser" VonDrehle Corporation (1 page).
"The Ultimate Washroom", Kruger Products, www.krugerproducts.com/afh. ULTCAT-003 (5 pages).
"Tork Elevation Dispensing Solutions" Lifting your washroom to a new level. www.torkusa.com/elevation (7 pages).
Office Action for European Application No. 14771748.2 dated May 11, 2016.
Translation of Office Action for Columbian Application No. 16090473 dated Jun. 24, 2016.
Office Action for Russian Application No. 2016113706 dated Jun. 8, 2016.
Australian Examination Report dated Jul. 25, 2016.
International Search Report and Written Opinion for Application No. PCT/US2014/055454 mailed Nov. 20, 2014.

* cited by examiner

TISSUE DISPENSER AND METHOD FOR DISPENSING TISSUE

CROSS-REFERENCE TO RELATED APPLICATION

The present application includes the disclosure of U.S. provisional application Ser. No. 61/877,771 that was filed with the United States Patent and Trademark Office on Sep. 13, 2013. A priority right is claimed to of U.S. provisional application Ser. No. 61/877,771 to the extent appropriate. The complete disclosure of U.S. provisional application Ser. No. 61/877,771 is incorporated herein by reference.

FIELD OF THE INVENTION

The disclosure relates to a tissue dispenser and to a method for dispensing tissue. The disclosure provides for conservation of tissue, such as toilet tissue, by requiring that a first roll of tissue is exhausted before a second roll of tissue can be accessed.

BACKGROUND

Numerous styles of tissue dispensers are available. One style of tissue dispenser found in many commercial establishments is a tissue dispenser where two rolls of tissue are located side by side. For that style of tissue dispenser, it is often the problem that a user will begin the second roll of tissue before the first roll of tissue is exhausted. The custodian who services the tissue dispenser often ends up replacing both partially used rolls with new rolls of tissue thereby resulting in waste. Examples of two roll dispensers are disclosed in U.S. Pat. Nos. 6,439,502; 6,202,956; 5,813,624; and 3,381,909. A dispenser that helps reduce waste by requiring depletion or substantial depletion of a first roll before access to a second roll is made available is disclosed in U.S. Pat. No. 7,083,138.

Toilet tissue rolls and other paper roll products, such as paper towel rolls, typically comprise a paper web material that is wound around a central core. The core helps to support the paper web material and define the shape of the roll, as well as define a central opening for interaction with a support structure, such as a mandrel, on a suitable dispensing apparatus. In many paper roll products, the core is a one piece structure that extends the entire width of the roll product. However, in some known paper roll products, the core is formed by core sections that are spaced apart from each other to form a gap between the core sections so that the total length of the core sections is less than the width of the web material wound onto the core sections. These reduced core paper roll products having spaced core sections separated by a gap help to reduce the amount of core stock material that is used in paper roll products. Examples of reduced core paper roll products are disclosed in U.S. Pat. Nos. 7,107,888; 6,648,267; and 6,491,251.

Exemplary tissue dispensers that encourage depletion of a roll of tissue before another roll of tissue is available are disclosed, for example, by U.S. Pat. Nos. 7,014,140; 6,648,267; and 6,491,251. There is a continuing need for tissue dispensers that encourage depletion of a first tissue roll before consuming a second tissue roll.

SUMMARY

A tissue dispenser is provided according to the invention. The tissue dispenser includes: (a) a housing and cover that attach together and form an interior region for holding multiple tissue rolls and a dispenser opening for dispensing tissue from the dispenser interior; (b) a first roll holder located within the interior region, the first roll holder comprising a first back panel and a first mandrel extending from the first back panel, the first back panel is constructed to rotate, relative to the housing, between a locked position and an unlocked position, and the first mandrel is constructed to receive a first tissue roll; (c) a second roll holder located within the interior region, the second roll holder comprising a second back panel and second mandrel extending from the second back panel, the second back panel is constructed to rotate relative to the housing, between a locked position and an unlocked position, and the second mandrel is constructed to receive a second tissue roll; and (d) a door constructed to move within the dispenser opening between a first position and a second position so that when the door is provided in the first position, tissue can be dispensed from the first tissue roll provided on the first mandrel, and when the door is provided in the second position, tissue can be dispensed from the second tissue roll positioned on the second mandrel, wherein the door is constructed so that when the door is provided in either the first position or the second position and tissue is dispensing from either the first roll or the second roll, then the door is unable to move to the other of the first position or the second position until the tissue being dispensed is exhausted.

A method for dispensing tissue is provided according to the invention.

DETAILED DESCRIPTION

Figure 1:
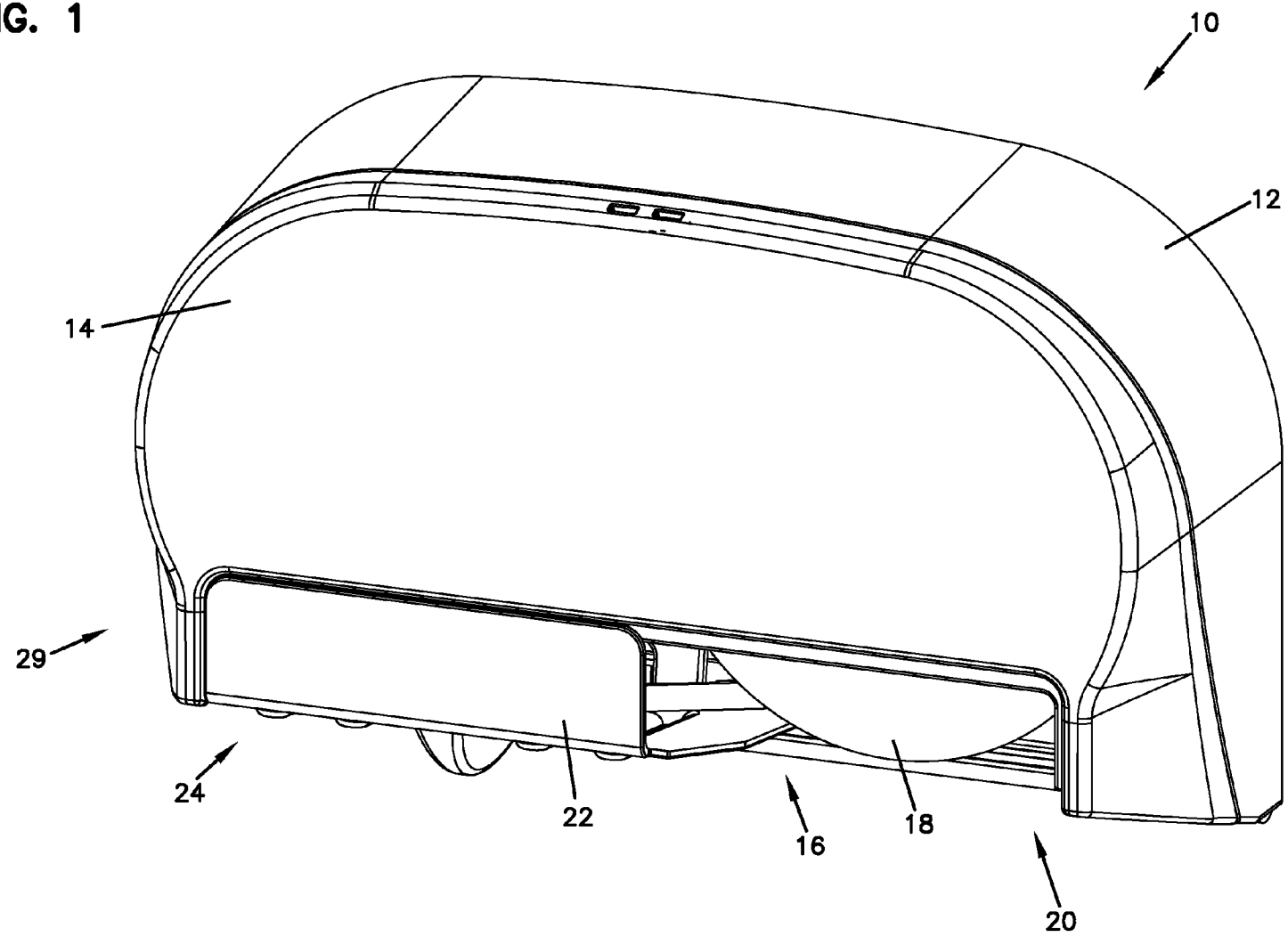
FIG. 1 is a perspective view of a tissue dispenser according to the principles of the invention.

A tissue dispenser is shown at reference number 10 in FIG. 1. The tissue dispenser 10 is shown having a tissue roll 18 located therein which can be accessed through an opening 20. The tissue dispenser 10 shown in FIG. 1 holds two tissue rolls although the dispenser can be constructed to include more than two tissue rolls according to the principles described herein. In general, the tissue dispenser permits dispensing from a single tissue roll until that tissue roll is exhausted (depleted or substantially depleted). Once a tissue roll is exhausted, the tissue dispenser permits dispensing from another roll that has been held in reserve. The reference to a tissue roll (or roll of tissue) being exhausted means that the tissue has been completely removed from the roll or substantially removed from the roll so that tissue dispenser 10 can be operated so that the door 22 is allowed to move (for example, slide) and thereby permit access to the other roll of tissue held in reserve within the dispenser 10. This tissue dispenser 10 can be referred to more simply as a dispenser, and can also be referred to as a two roll or multi-roll dispenser. The tissue provided on the tissue roll can be provided as toilet tissue. The tissue dispenser 10 can be a wall mounted dispenser which means that the dispenser would be mounted on a wall in a toilet stall or water closet.

The tissue dispenser 10 is constructed so that the tissue rolls are mounted on mandrels extending generally perpendicular to the wall on which the dispenser is mounted. An advantage of this type of configuration is that the dispenser can contain relatively large diameter tissue rolls without extending too far away from the wall. In contrast, dispensers that have a mandrel extending parallel to a wall on which the dispenser is mounted tend to be limited to relatively smaller tissue roll sizes so that the dispenser does not extent too far away from the wall. It is generally desirable for tissue dispensers to have a depth (a distance the dispenser extends away from the wall) that is less than 7 inches away from the wall. A tissue dispenser that extends further than 7 inches away from a wall on which it is mounted may crowd the toilet user. In addition, certain regulations may limit the extent to which a tissue dispenser can extend away from the wall in certain commercial facilities. By providing the dispenser with mandrels that extend perpendicular to the wall, it is possible to increase the diameter of the tissue roll beyond the standard size of 5.25 inches without increasing the distance the tissue dispenser extends from the wall. For example, the tissue roll can have a diameter of about 5.5 inches to about 15 inches, or about 7 inches to about 14 inches. Common large diameter tissue rolls are often available in sizes of 7.2 inches, 9 inches, and 12 inches. An advantage of a dispenser using larger diameter tissue rolls is that the dispenser may require less frequent servicing compared to dispensers containing smaller diameter tissue rolls. In addition, by requiring that a tissue roll is exhausted before a new tissue roll can be accessed, the tissue dispenser 10 can help conserve tissue while still providing that a sufficient amount of tissue is available to a user between service intervals.

In FIG. 1, the tissue dispenser 10 is shown having a dispenser housing 12 and a cover 14. The housing 12 and cover 14 from an interior region 16 that contains multiple tissue rolls. In FIG. 1, the tissue roll 18 is available for dispensing tissue therefrom through the opening 20. Another roll can be provided within the tissue dispenser 10 (although not visible in FIG. 1). The door 22 is permitted to move within the opening 20 between a first position 24 which corresponds to a position where a user is able to access tissue from the first tissue roll 18 to a second position 26 (FIG. 2) which corresponds to a position where the user is able to access tissue from a tissue roll held in reserve.

Figure 2:
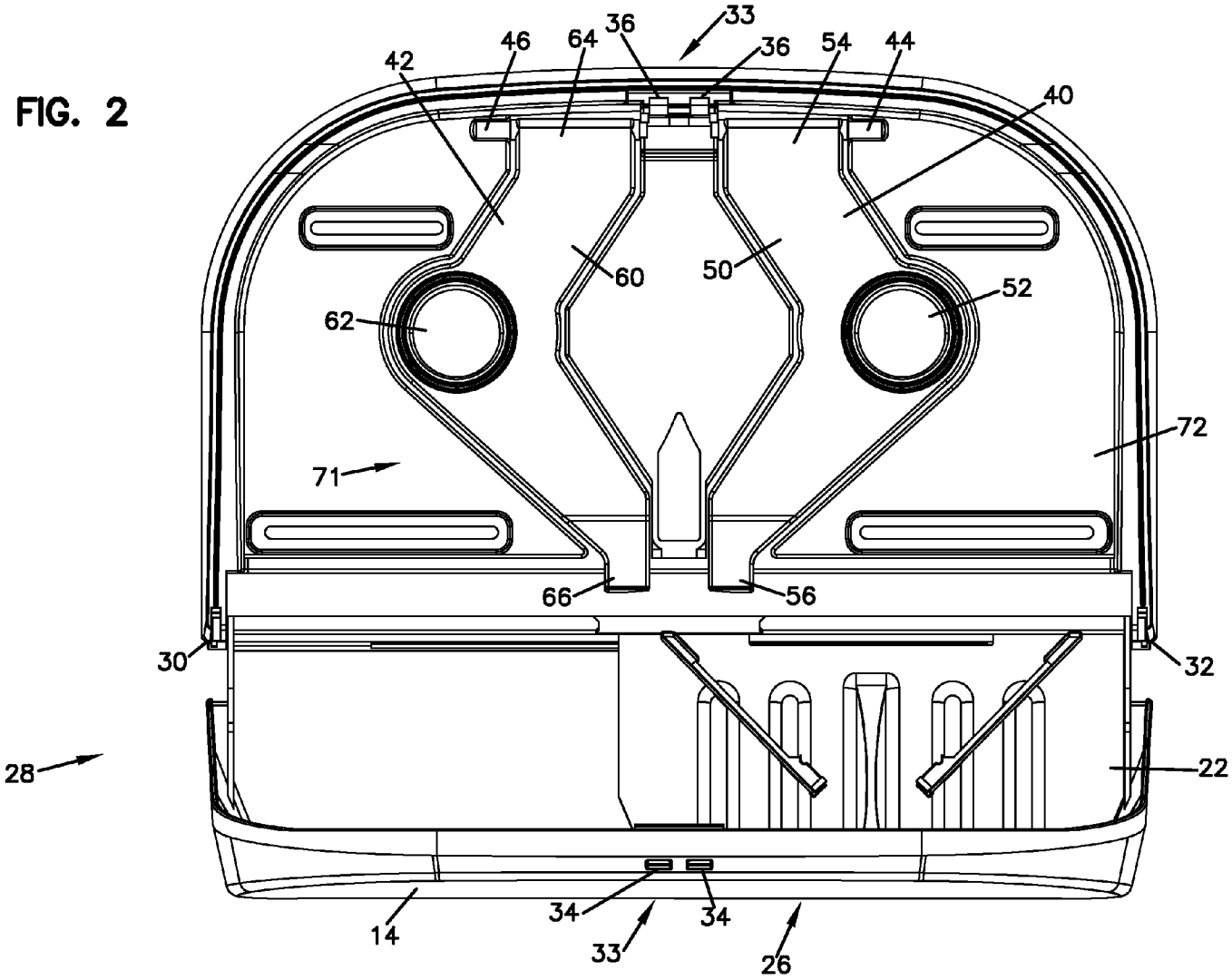
FIG. 2 is a front view of the tissue dispenser of FIG. 1 with the cover in an open position and with the rolls of tissue removed.
Figure 3:
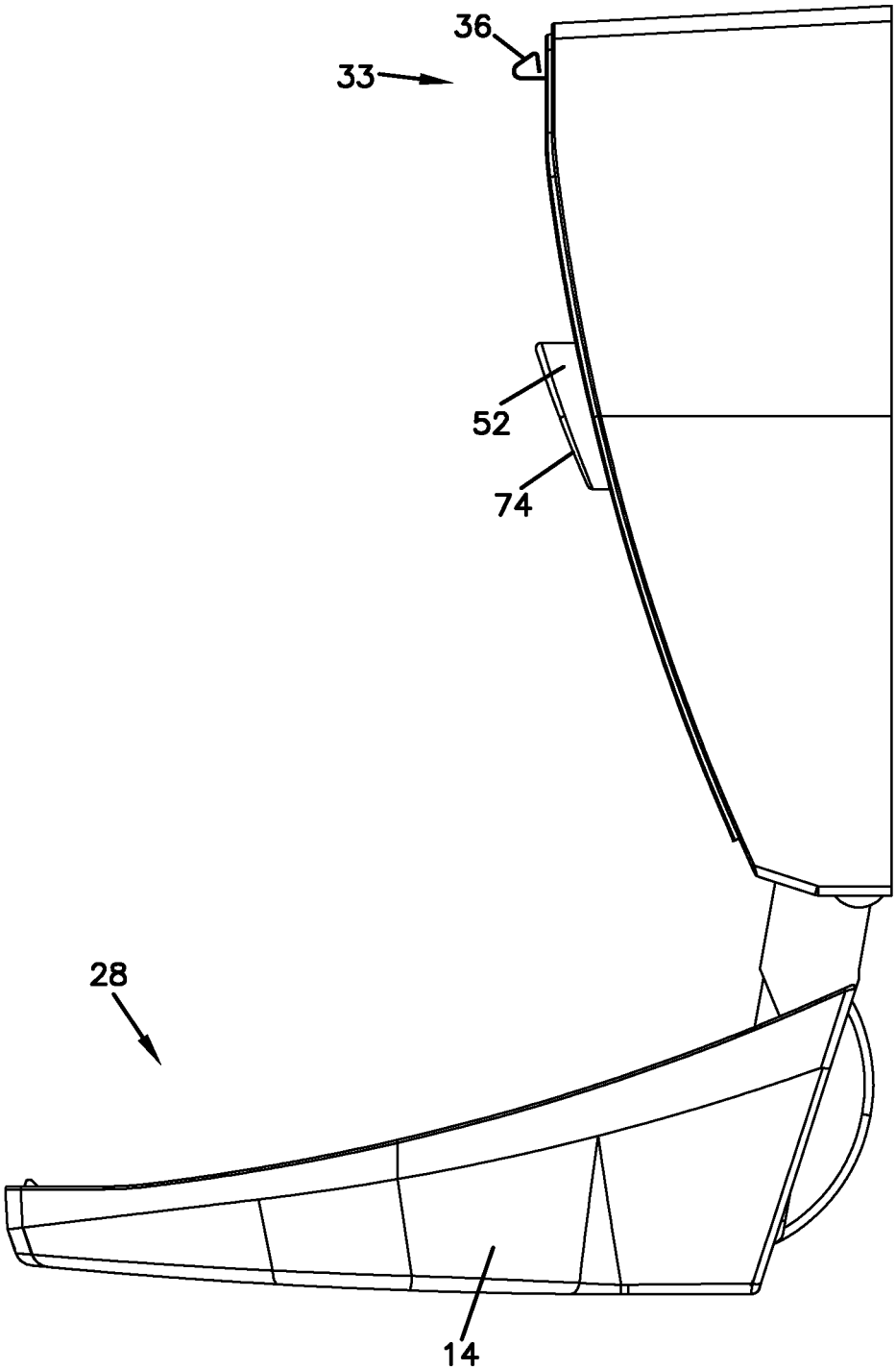
FIG. 3 is a side view of the tissue dispenser of FIG. 2.

Now referring to FIGS. 2 and 3, the tissue dispenser 10 is shown wherein the cover 14 is provided in an open position 28 and the tissue roll 18 has been removed. In addition, the door 22 has been moved to a second position 26. The cover 14 is shown attached to the housing 12 at the hinge attachments 30 and 32. The hinge attachments 30 and 32 permit the cover 14 to rotate between a closed position 29 shown in FIG. 1 and an open position 28 shown in FIG. 2 while still remaining attached together. The tissue dispenser can be provided without the hinge attachments 30 and 32. For example, the cover 14 can be constructed so that it can be removed from the housing 12. The housing 12 and the cover 14 can include a latch arrangement 33 for holding the housing 12 and the cover 14 together. The latch arrangement 33 is shown as a latch opening 34 on the cover 14 that engages a latch 36 on the housing 12. Of course, the latch arrangement 33 can be reversed to that the latch opening (or recess) is provided on the housing 12 and the latch is provided on the cover 14. Alternatively, the cover 14 can be held to the housing 12 by a lock arrangement. A lock arrangement may be advantageous when it is desired that the custodian servicing the tissue dispenser has access to the interior region 16 but the general public does not.

A first roll holder 40 and a second roll holder 42 are rotatably connected to the housing 12 at hinge locations 44 and 46. The phrase "rotatably connected" means that the first roll holder 40 and the second roll holder 42 are constructed to rotate relative to the housing at the hinge locations 44 and 46. In general, it is expected that the housing 12 will be mounted to a wall and, therefore, provided in a fixed location. The first roll holder 40 and the second roll holder 42 are then permitted, under certain circumstances, to rotate about the hinge locations 44 and 46. The first roll holder 40 includes a first back panel 50 and a first mandrel 52. The first back panel 50 extends from a first end 54 at the hinge location 44 to a second end 56. The first mandrel 52 extends away from the first back panel 50 to permit mounting a roll of tissue thereon. In general, the roll of tissue mounted on the first mandrel 52 can be referred to as the first tissue roll or the first roll. The second roll holder 42 includes a second back panel 60 and a second mandrel 62. The second back panel 60 extends from a first end 64 at the hinge location 46 to a second end 66. The second mandrel 62 extends away from the second back panel 60 to permit mounting a roll of tissue roll thereon. In general, the roll of tissue mounted on the second mandrel 62 can be referred to as the second tissue roll or the second roll.

Figure 4:
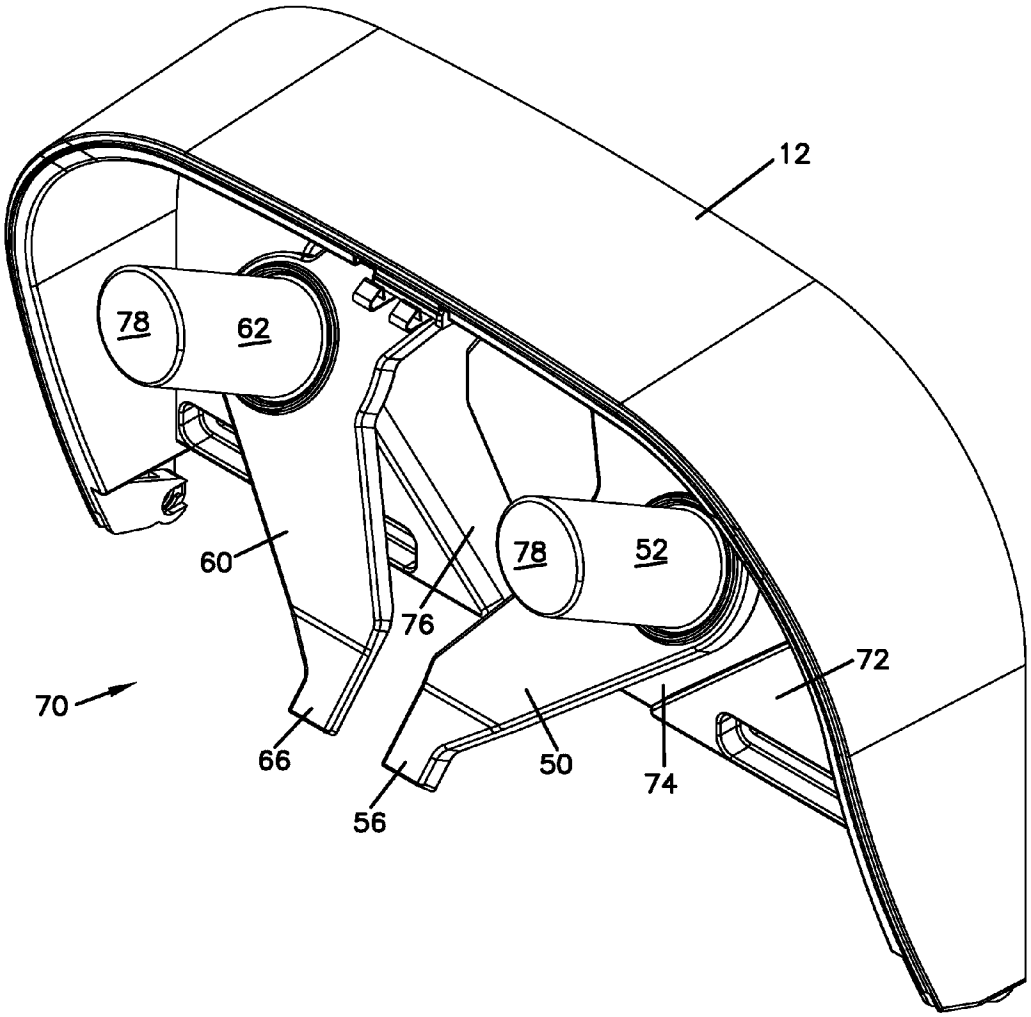
FIG. 4 is a perspective view of the housing of the dispenser of FIG. 1.
Figure 5:
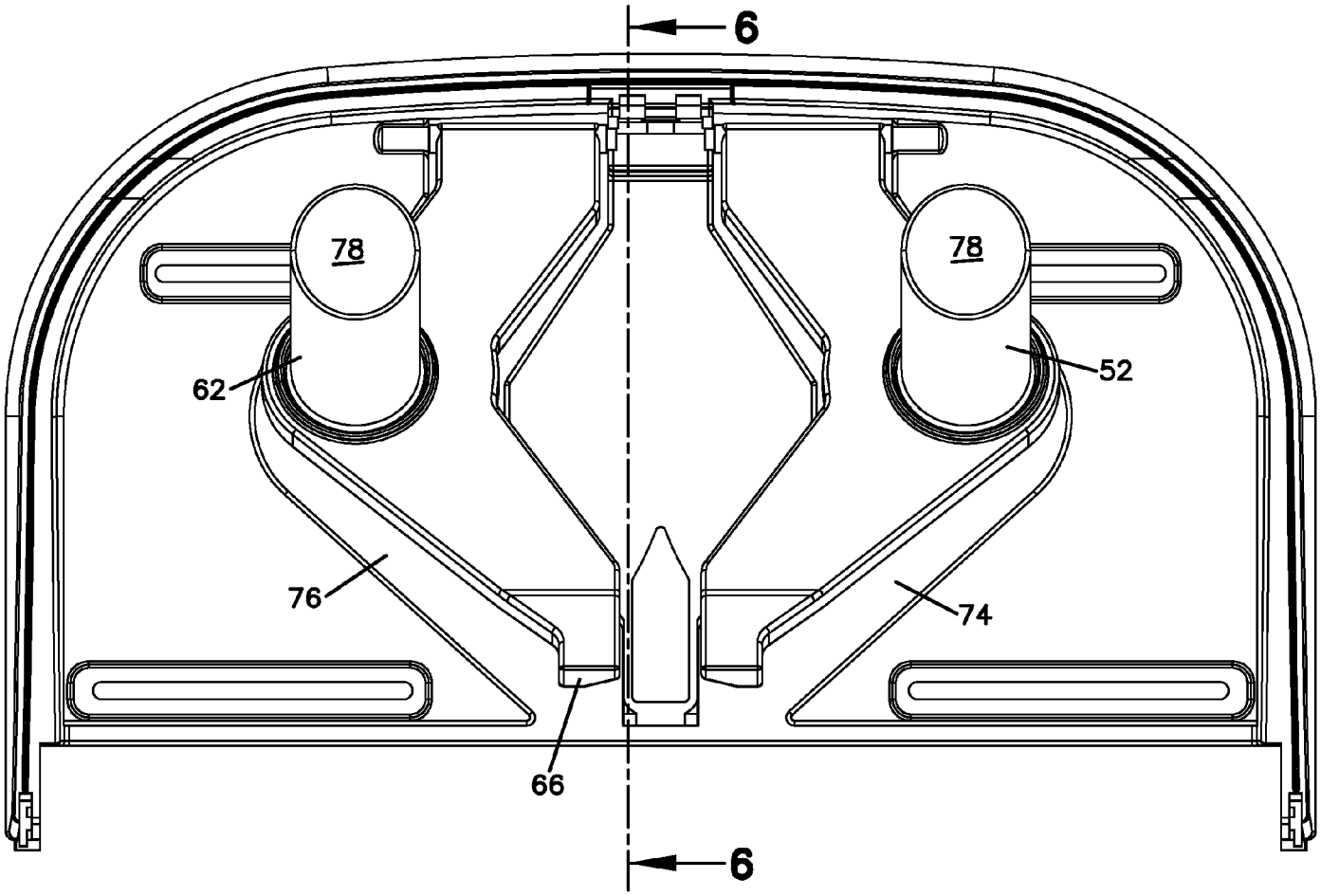
FIG. 5 is a front view of the housing of FIG. 4.
Figure 6:
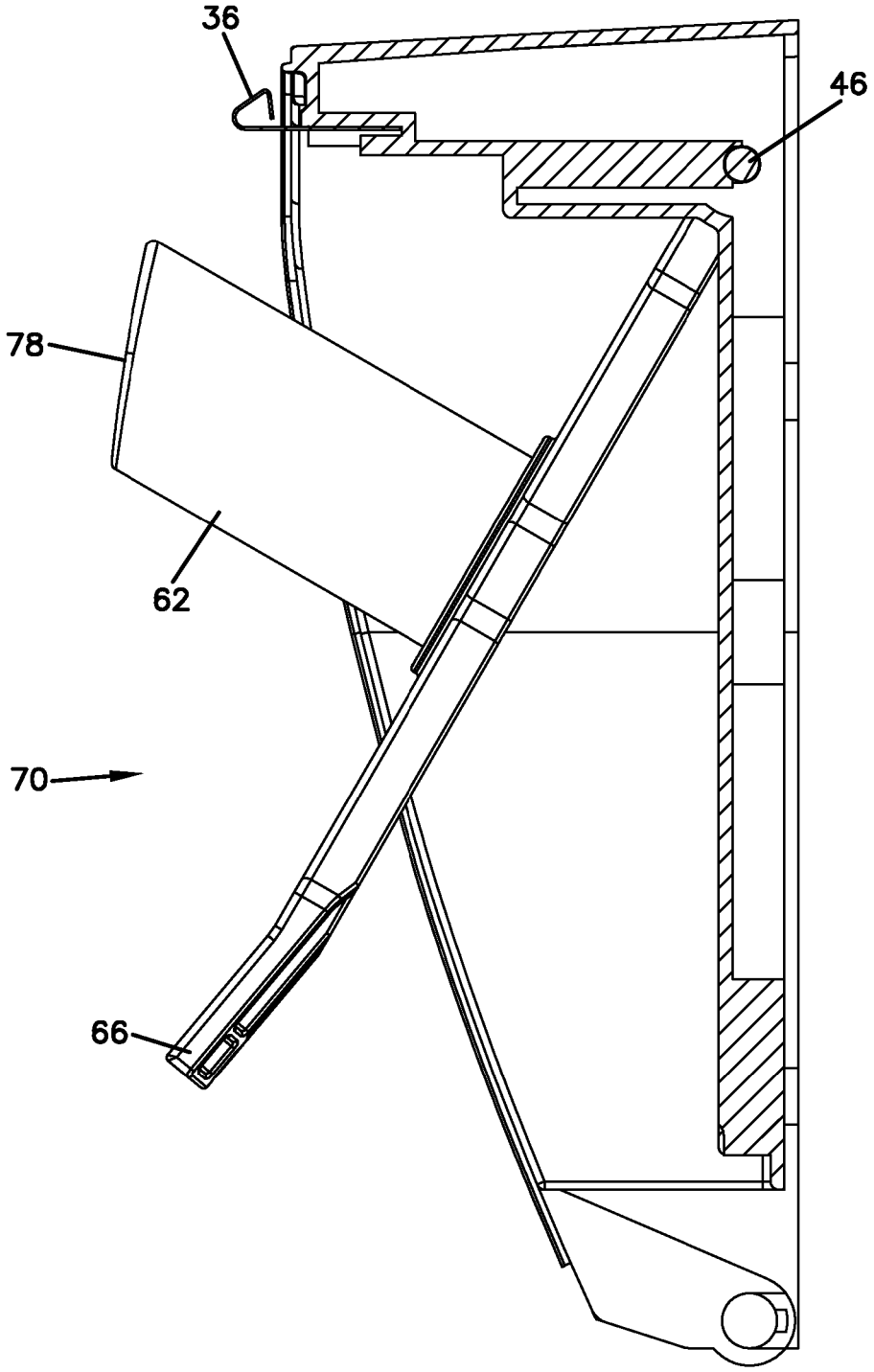
FIG. 6 is a sectional view taken along line 6-6 of FIG. 5.

Now referring to FIG. 4-6, the first back panel 50 and the second back panel 60 are shown rotated relative to the housing 12. The position of the first back panel 50 and the second back panel 60 in FIG. 4 can be referred to as an unlocked position 70 or as a release position because it is this position that allows the door 22 to move between the first position 24 and the second position 26. Once tissue on a tissue roll located on the first mandrel 52 or the second mandrel 62 is exhausted, the door 22 can be moved causing the first back panel 50 or the second back panel 60 to be rotated into the unlocked position 70. This will be explained in more detail below. During typical operation, both the first mandrel 52 and the second mandrel 62 will contain a roll of tissue thereon and the first back panel 50 and the second back panel 62 can lie generally vertically against the back wall 72 of the housing 12. This orientation can be referred to as the locked position 71 (see FIG. 2) or as the dispensing position. As shown, the first back panel 50 and the second back panel 60 can be received within the back wall first pattern or recess 74 and the back wall second pattern or recess 76 that are recessed in the back wall 72 and are constructed to receive the first back panel 50 and the second back panel 60 so that the first back panel 50 and the second back panel 60 do not extend beyond the back wall 72 when provided in the locked position 71. The tissue dispenser 10 permits dispensing from one tissue roll at a time located on either the first mandrel 52 or the second mandrel 62. Once the tissue is exhausted from the tissue roll that is accessed, the door 22 can slide between the first position 24 and the second position 26 resulting in the first back panel 50 or the second back panel 60 (whichever one has the roll of tissue that has been exhausted) to be rotated to the unlocked position 70 thereby permitting access of the tissue roll held in reserve on the other of the first mandrel 52 or the second mandrel 62.

The first mandrel 52 and the second mandrel 62 are shown having a slanted end 78. The slanted end 78 is provided at an angle that allows the first back panel 52 or the second pack panel 62 to rotate to the unlocked positioned 70 while the cover 14 is provided in the closed position 29. Tissue rolls for use in the tissue dispenser 10 are preferably sized to fit within the interior region 16 of the tissue dispenser 10 so that they have a width that extends beyond the length of the first mandrel 52 and the second mandrel 62. Such tissue rolls can either be cored or non-cored. A "core" generally refers to the cylindrical paper tube (typically cardboard) about which the web of tissue is wrapped. The core helps the roll maintain its shape and permits the roll of tissue to rotate relatively freely. In the case of a non-cored tissue roll, once the tissue is exhausted from the tissue roll, there is no tissue that prevents the back panel 50 or 60 from rotating into the unlocked position 70. In the case of a cored tissue roll, once the tissue is exhausted from the tissue roll, the core remains. In the case of a full length core, at least a part of the core would need to be removed in order to permit the back panel 50 or 60 to rotate into the unlocked position 70. An exemplary core that could be used is a "bursting" type core that is sometimes used in industrial and institutional applications. Bursting cores are intended to come apart after the tissue has been removed, leaving the mandrel bare. Alternatively, the tissue roll can have a core that is manually removed once the tissue is depleted. Manually removing the core may pose some difficulties because it may require a user to reach his or her hand in through the opening 20 in order to grasp the core. Furthermore, a user's hand may not fit through the opening 20. Preferably, the tissue roll can be provided with a reduced core design. In general, reduced core tissue rolls are tissue rolls having cores comprised of first and second core sections that are spaced apart from each other to form a gap between facing ends thereof so that the total length of the core sections is less than the width of the tissue wound onto the core sections. Exemplary reduced core designs are disclosed, for example, in U.S. Pat. Nos. 7,107,888; 6,648,267; and 6,491,251.

Figure 10:
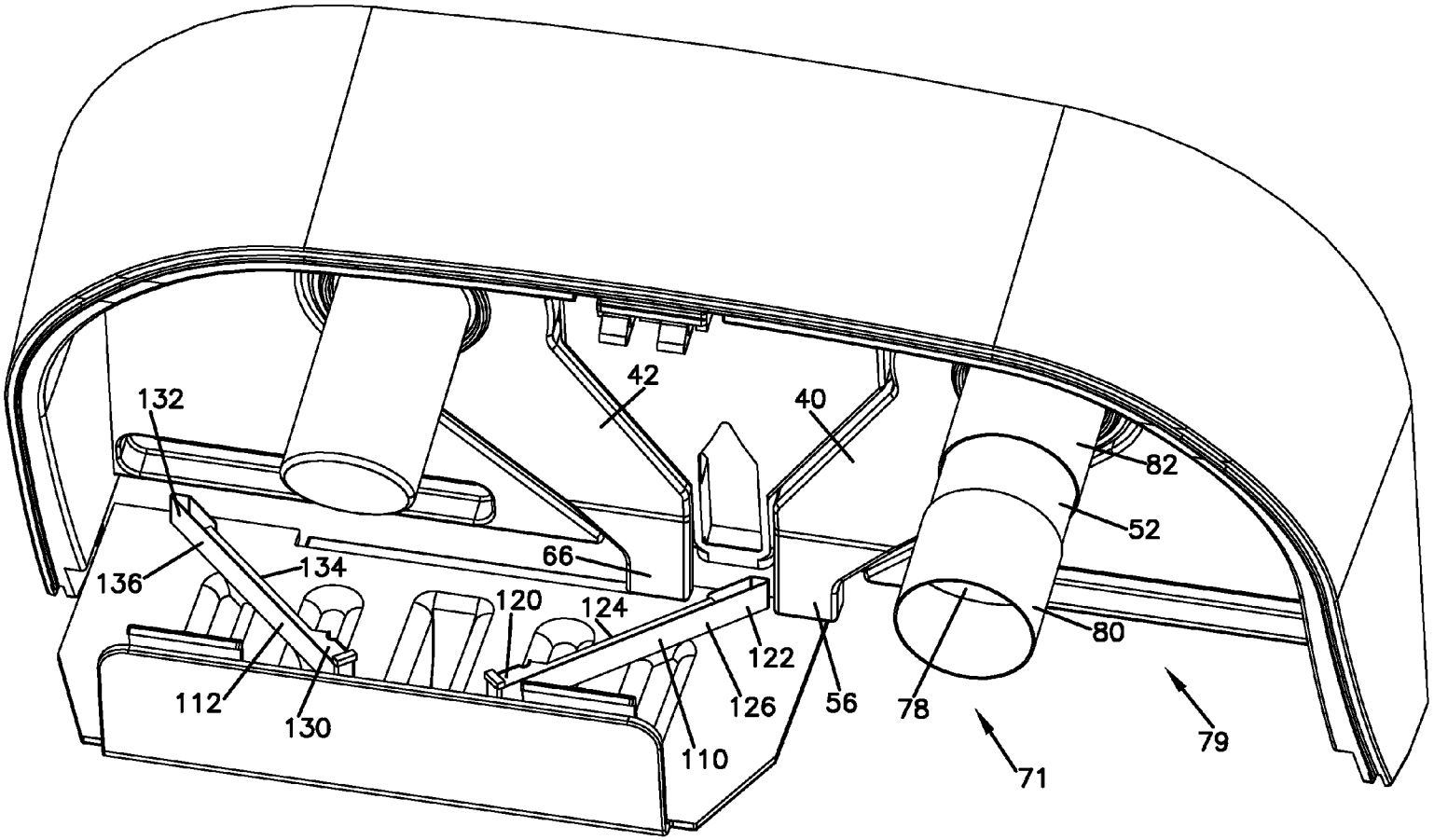
FIG. 10 is a perspective, partial assembly view of the dispenser of FIG. 1.

In FIG. 10, a tissue core 79 is shown located on the first mandrel 52. The tissue core 79 includes a first core section 80 and a second core section 82. In addition, the first roll holder 40 and the second roll holder 42 are both shown in the locked position 71. Once the first roll holder 40 is rotated into the unlocked position 70, and assuming that the cover 14 is provided in a closed position 29, the first core section 80 will collapse onto the second core section 82 once the slanted end 78 of the first mandrel 52 engages the cover 14. Because the roll of tissue has been exhausted, there is no longer any tissue causing the first core section 80 and the second core section 82 to remain separate, and pressure against the first core section 80 as the first mandrel 52 moves toward the cover 14 should be sufficient force to cause the first core section 80 to collapse onto the second core section 82.

Figure 7:
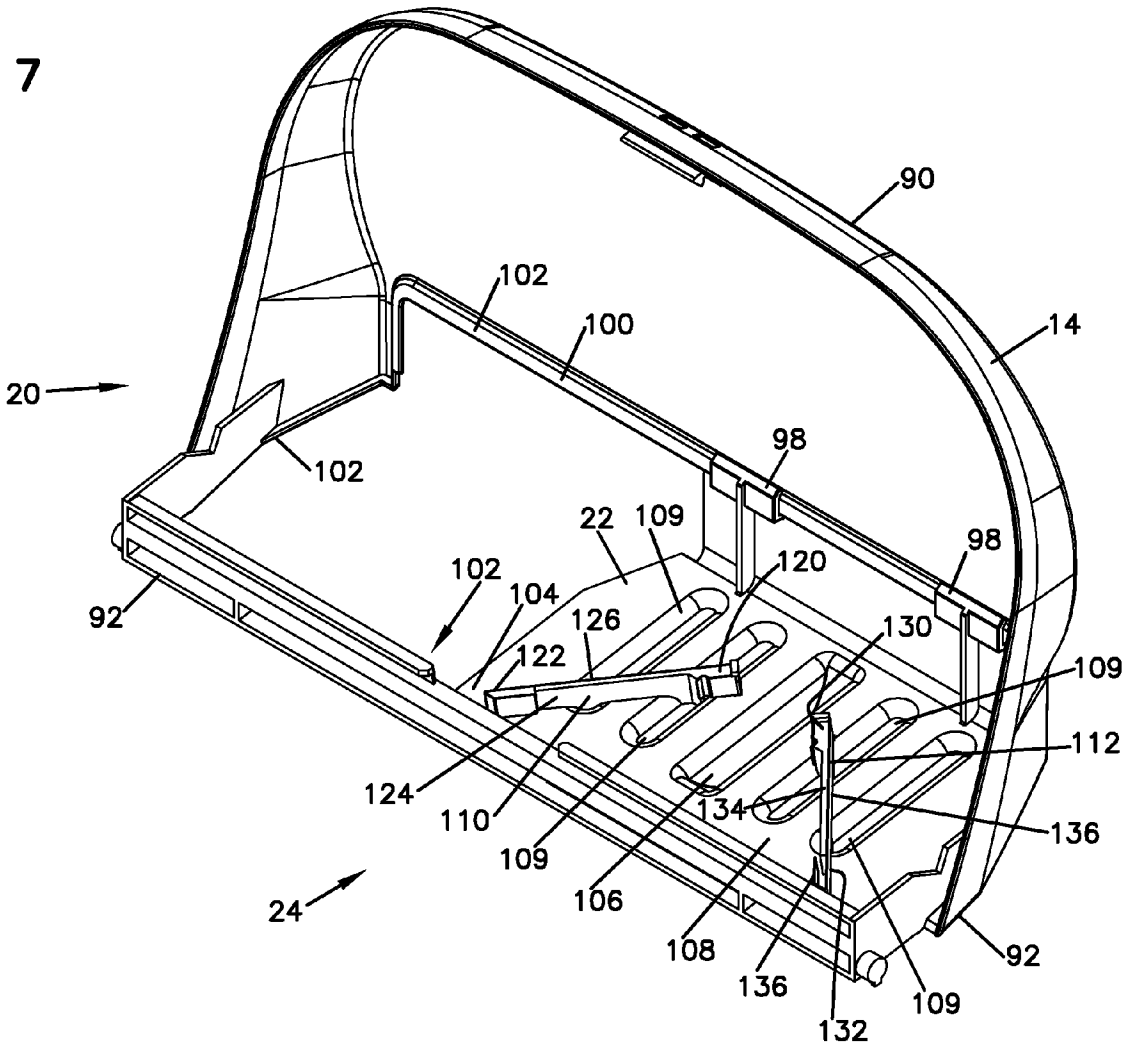
FIG. 7 is a perspective view of the cover of the dispenser of FIG. 1.
Figure 8:
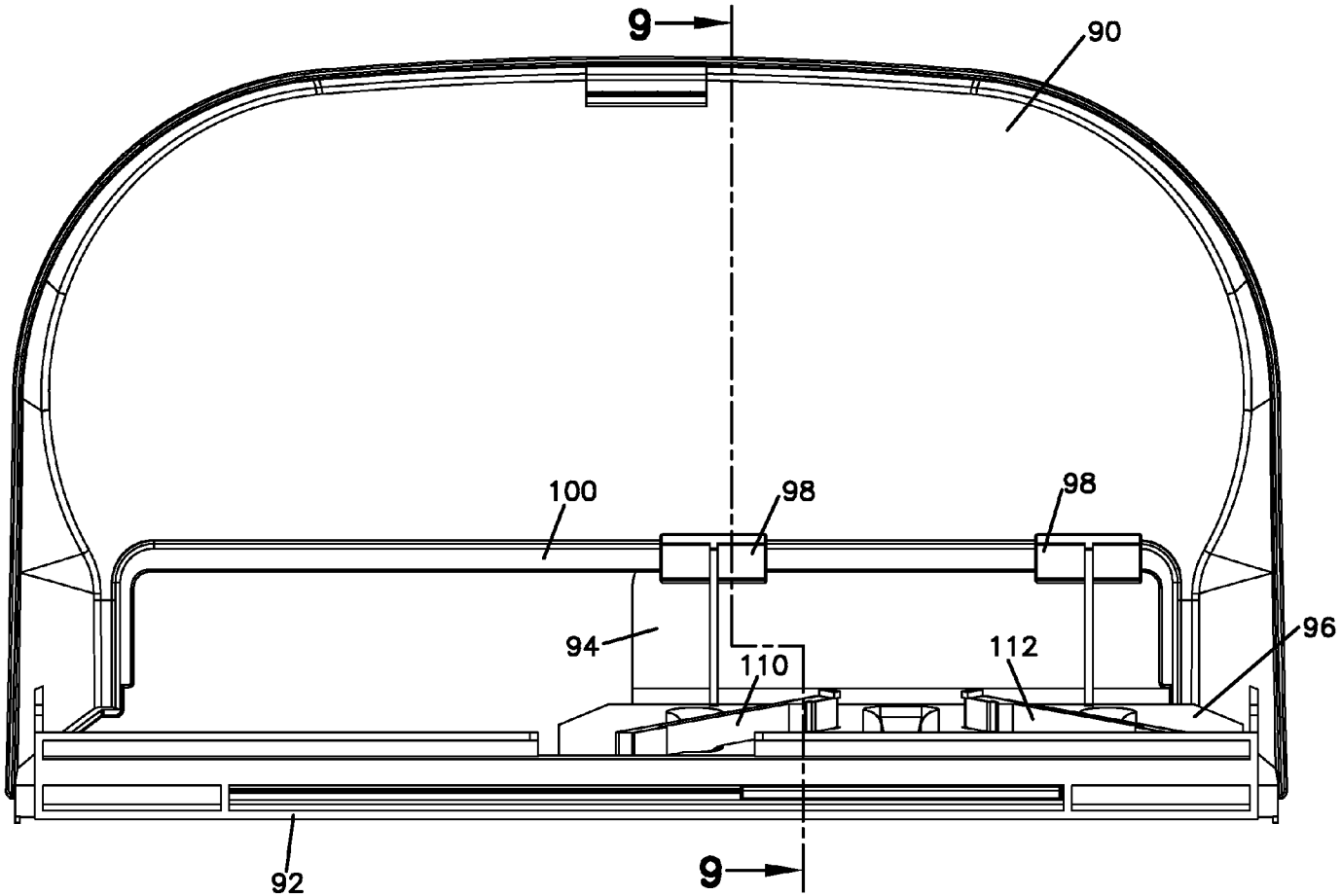
FIG. 8 is a front view of the cover of FIG. 7.
Figure 9:
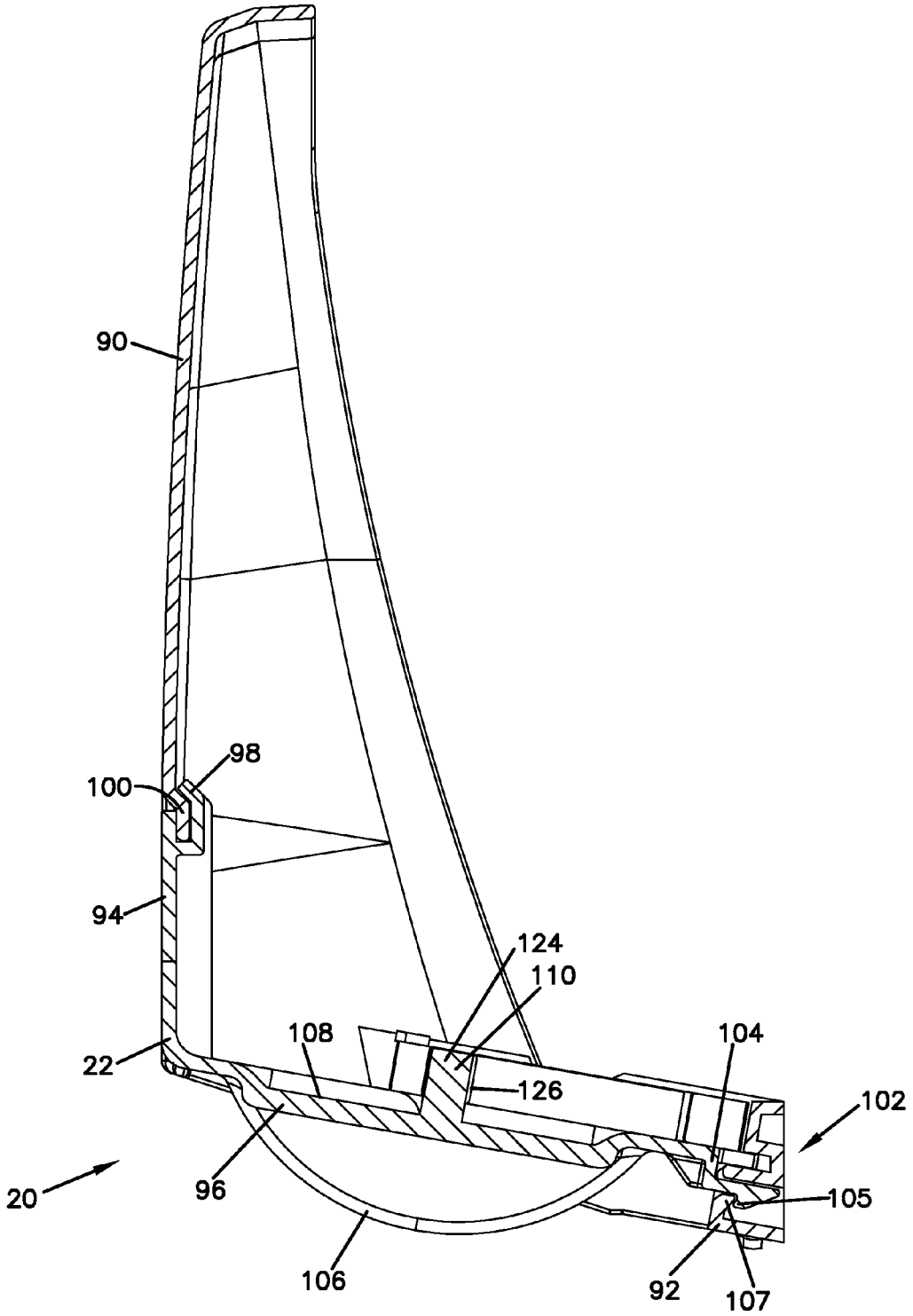
FIG. 9 is a sectional view taken along line 9-9 of FIG. 8.

Now referring to FIGS. 7-9, the cover 14 is described in more detail. The combination of the housing 12 and the cover 14 provides an interior region 16 housing at least one, and preferably 2 (or even more) tissue rolls, and permits access of a single roll at a time through an opening 20. For the cover shown, the cover includes a front portion 90 and a bottom portion 92. The opening 20 is provided along both the front portion 90 and the bottom portion 92. For the cover 14, the opening 20 is surrounded by the front portion 90 and the bottom portion 92. Within the opening 20 is a door 22, and the door 22 is constructed to slide within the opening 20 from a first position 24 to a second position 26. The door 22 includes a front door member 94 and a bottom door member 96. The front door member 94 includes sliders 98 that engage a rail 100 extending along a perimeter 102 of the opening 20 in the front portion 90. The bottom door member 96 includes a rearward part 104 that slides along the bottom portion 92. The rearward part 104 includes a hook member 105 that engages a protrusion 107 on the bottom portion 92. The interaction between the hook member 105 and the protrusion 107 locks the door 22 in a sliding relationship along the perimeter 102 of the opening 20 along the bottom portion 92. This interaction prevents the door 22 from moving forward (that is, away from the housing back wall 72). The bottom door number 96 includes a handle 106 that allows a user to slide the door 22 between the first position 24 and the second position 26. Additional contours 109 can be provided.

Figure 11:
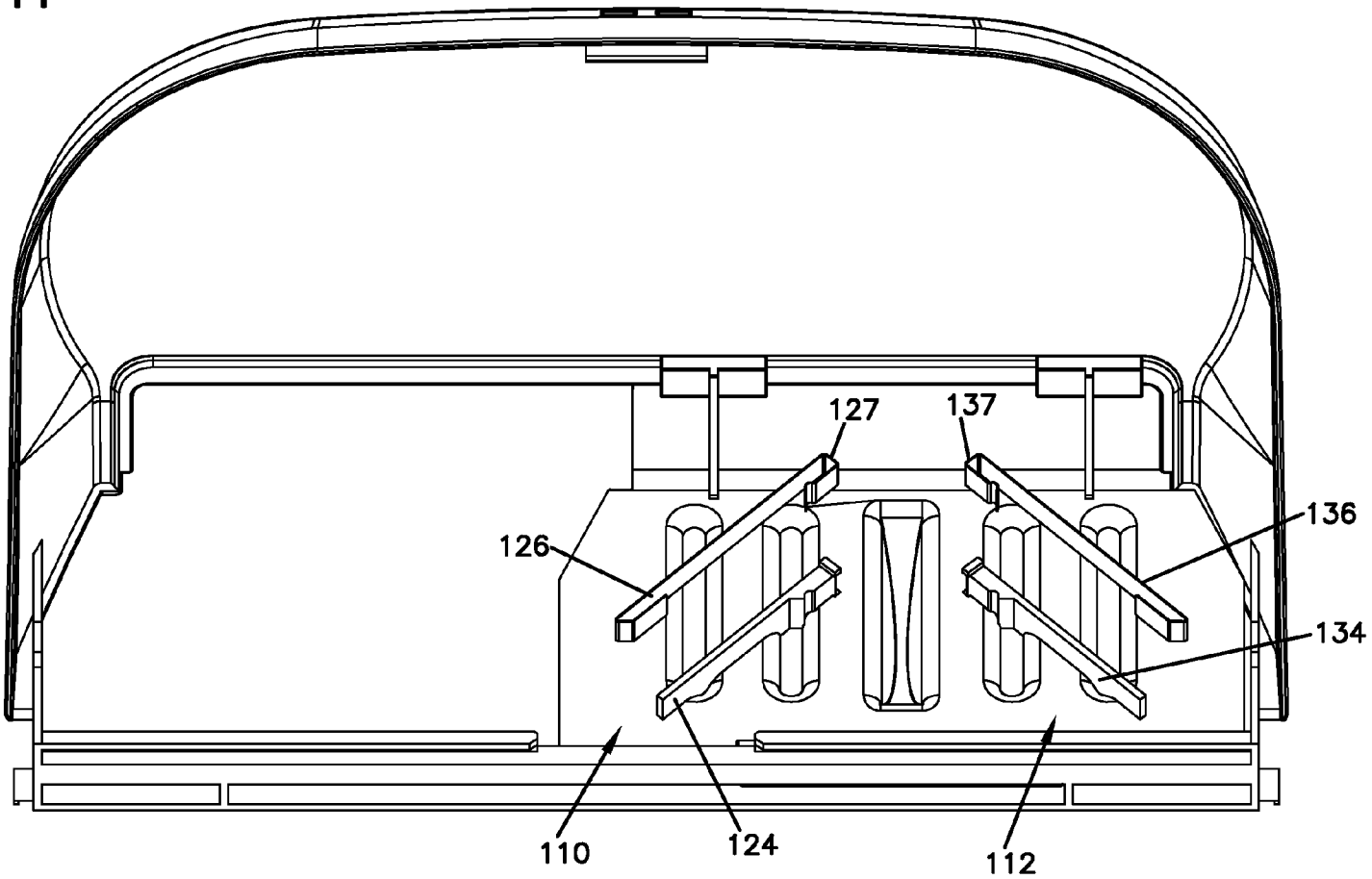
FIG. 11 is a perspective, partial exploded view of the dispenser of FIG. 1.

The bottom door member 96 includes an interior facing surface 108, and provided along the interior facing surface 108 extending toward the interior region 16 are a first locking member 110 and a second locking member 112. The first locking member 110 includes an anchor end 120 and a rotating end 122. The rotating end 122 is constructed to engage the second end 56 of the first back panel 50. When the first locking member 110 is viewed from the perspective of FIG. 10, the rotating end 122 does not rotate in a counter clockwise direction, but is permitted to rotate in a clockwise direction. The first locking member 110 includes a rib 124 and a transfer spring 126. It is the transfer spring 126 that is permitted to rotate in a clockwise direction. The rib 124 prevents the transfer spring 126 from rotating in a counter clockwise direction. The rib 124 is preferably integral with the door 22. Similarly, the second locking member 112 includes an anchor end 130 and a rotating end 132. The rotating end 132 is constructed to engage the second end 66 of the back panel 60. When the second locking member 112 is viewed from the perspective of FIG. 10, the rotating end 132 does not rotate in a clockwise direction, but is permitted to rotate in a counter clockwise direction. The second locking member 112 includes a rib 134 and a transfer spring 136. It is the transfer spring 136 that is permitted to rotate in a counter clockwise direction. The rib 134 is preferably integral with the door 22. The rib 134 prevents the transfer spring 136 from rotating in a clockwise direction. FIG. 11 illustrates the first locking member 110 and second locking member 112 by separating the transfer spring 126 from the rib 124, and by separating the transfer spring 136 from the rib 134. The transfer springs 126 and 136 include portions 127 and 137 that wrap the ribs 124 and 134 respectively, to form the anchor ends 120 and 130.

Figure 12:
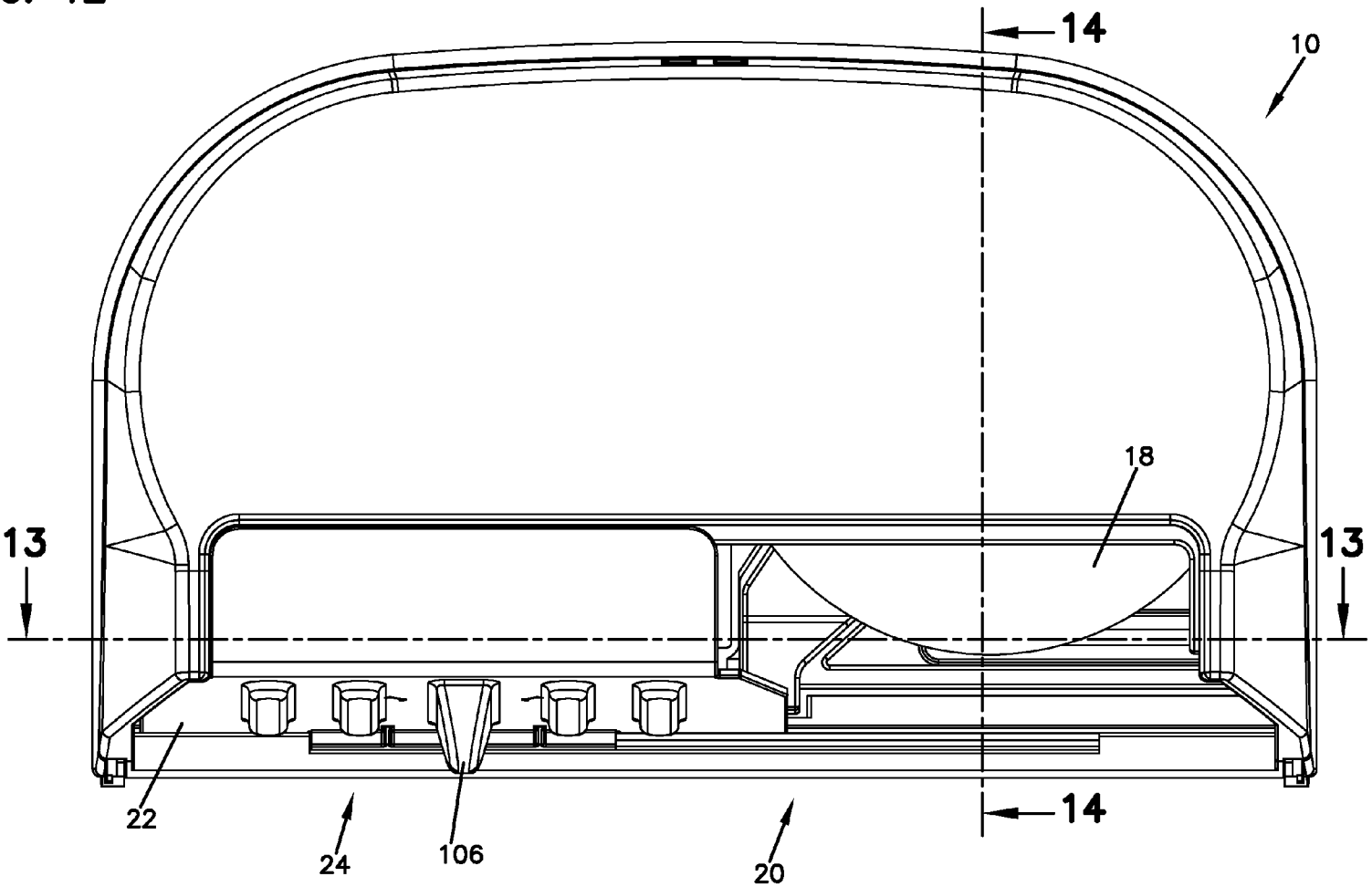
FIG. 12 is front view of the dispenser of FIG. 1 showing sectional lines 13-13 and 14-14.
Figure 13:
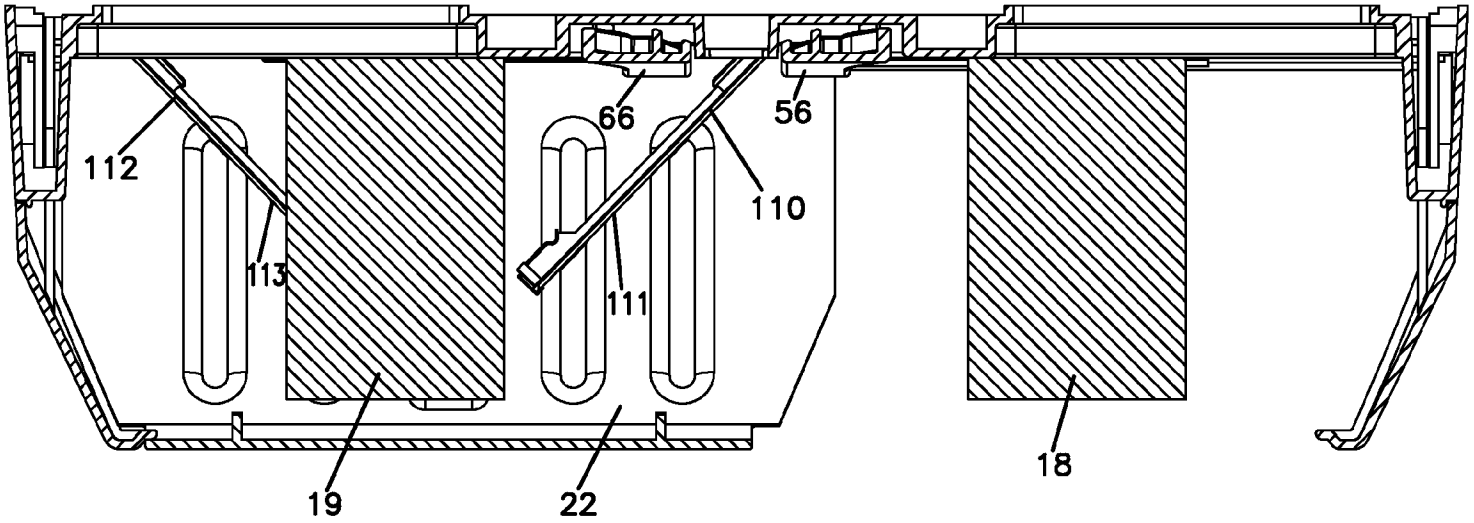
FIG. 13 is a sectional view taken along line 13-13 of FIG. 12.
Figure 14:
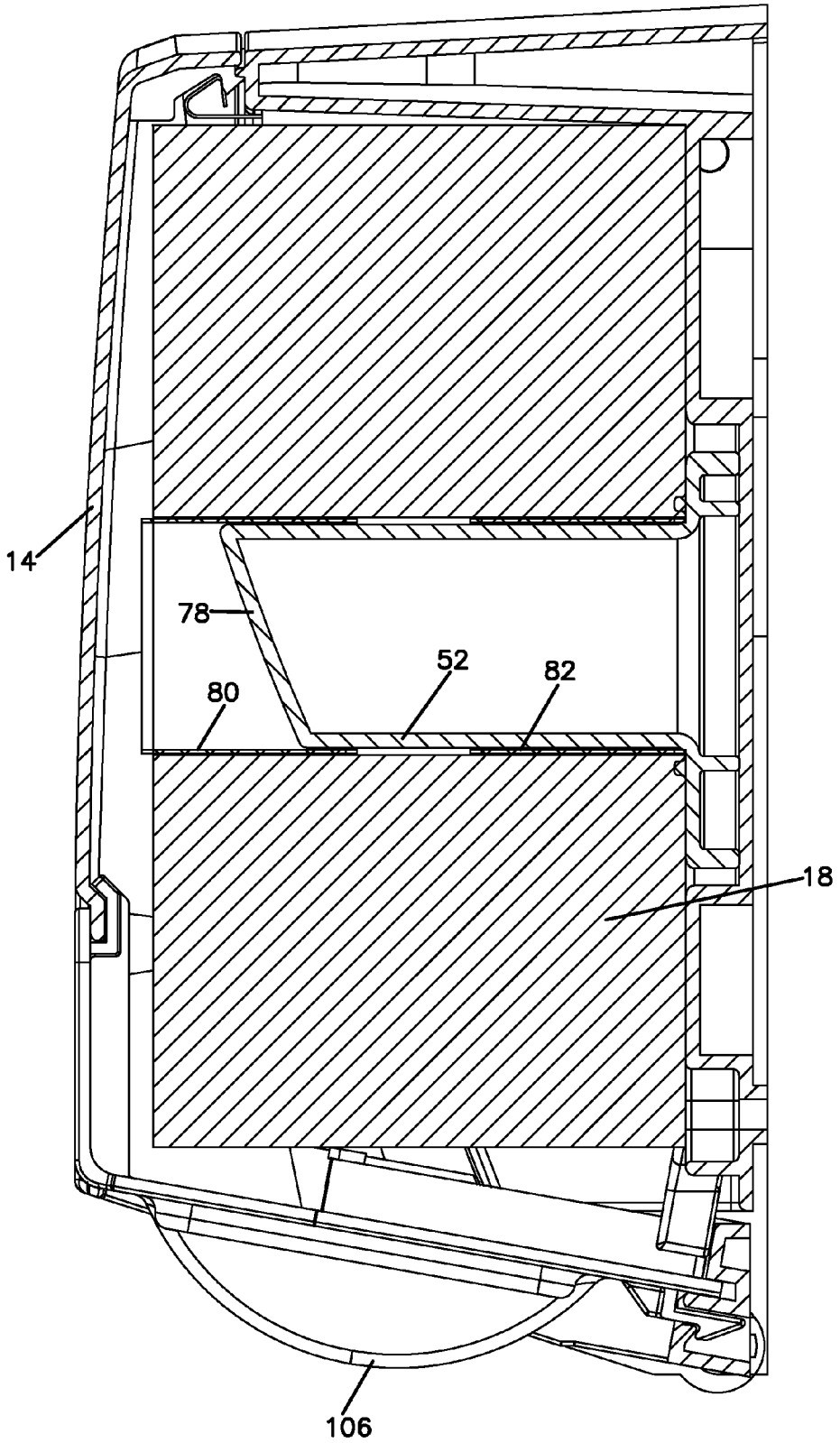
FIG. 14 is a sectional view taken along line 14-14 of FIG. 12.
Figure 15:
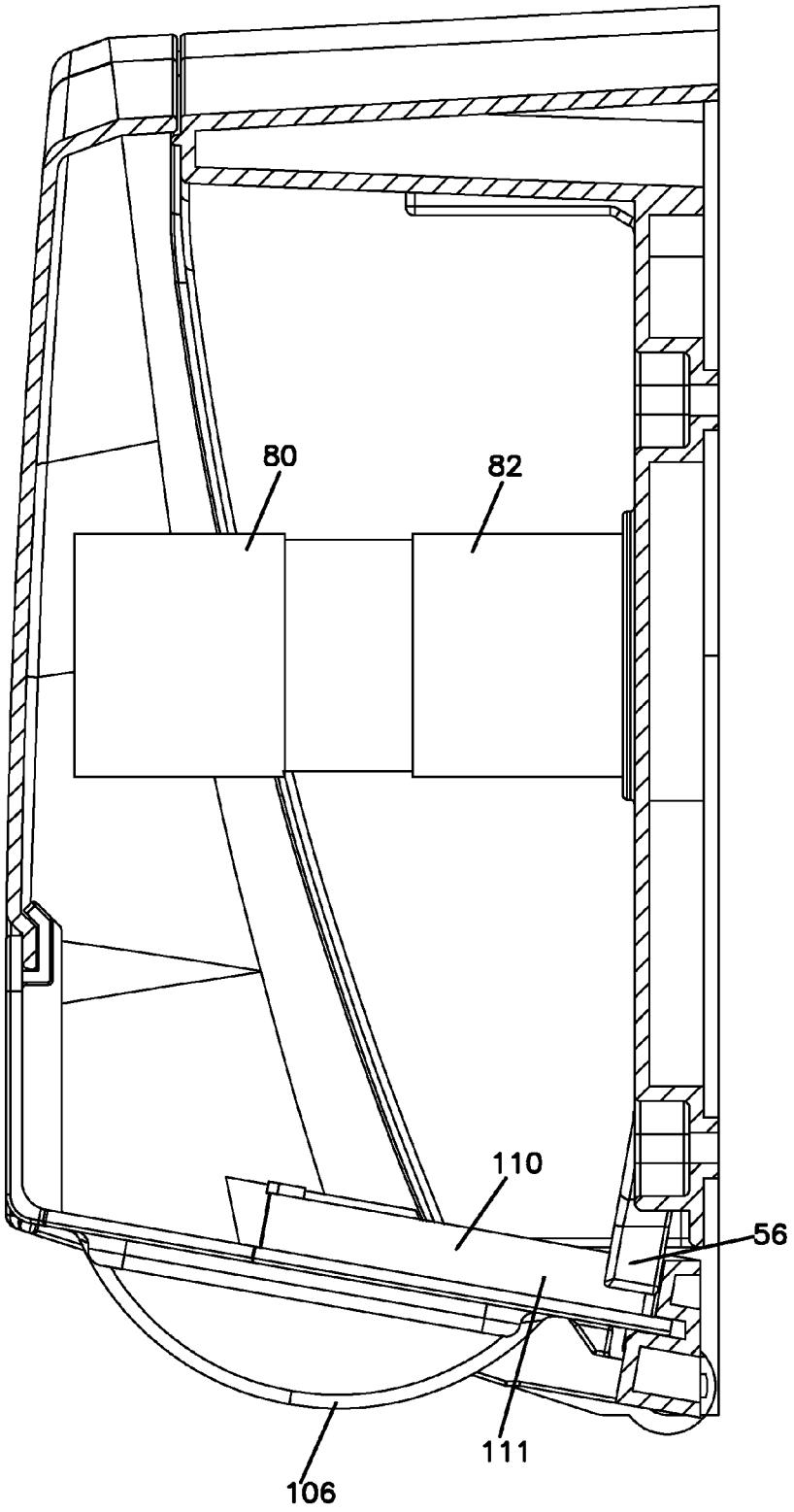
FIG. 15 is a sectional view of the tissue dispenser of FIG. 12 except the tissue has been exhausted.
Figure 16:
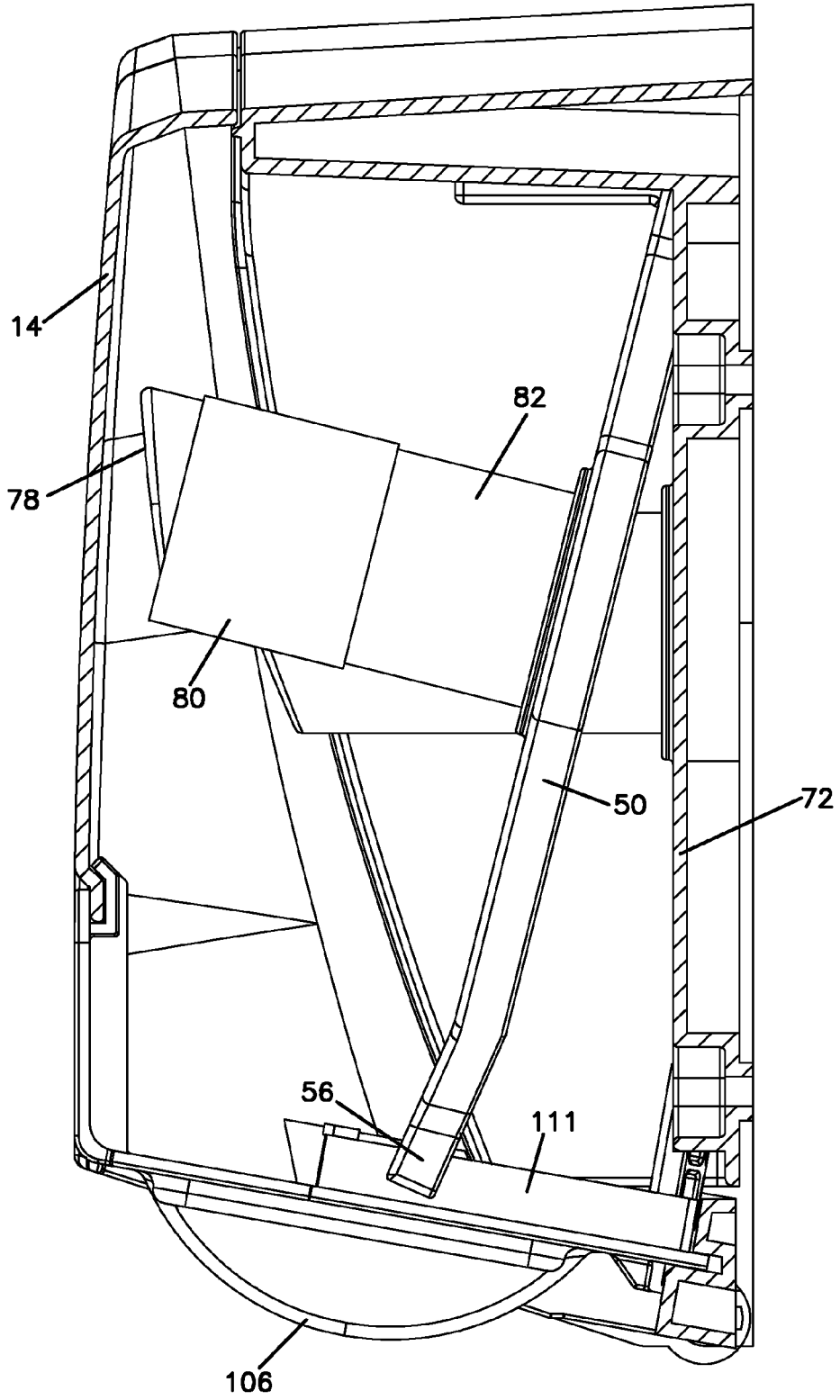
FIG. 16 is a sectional view of the dispenser of FIG. 12 except the tissue holder has been rotated forward.
Figure 17:
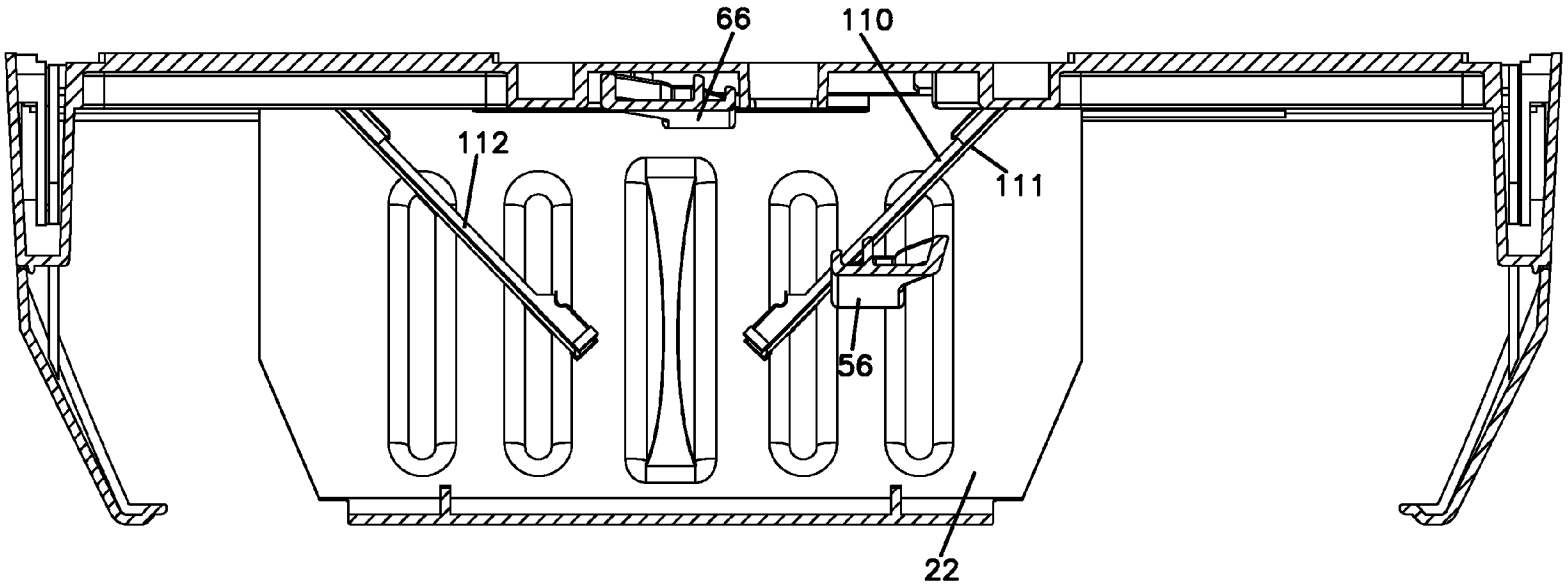
FIG. 17 is a sectional view similar to FIG. 13 except the door has moved.
Figure 18:
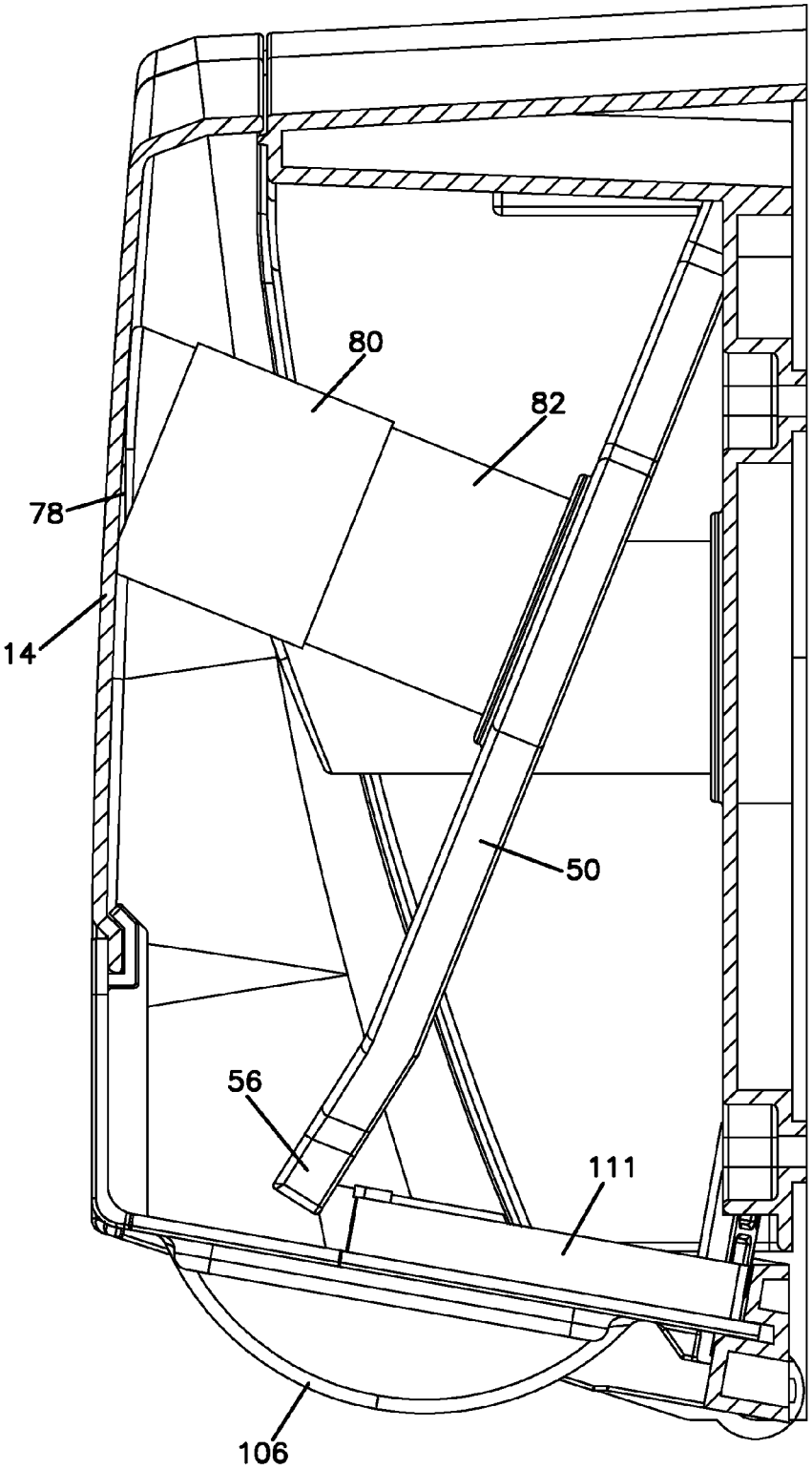
FIG. 18 is a sectional view of the dispenser of FIG. 12 except that the holder is completely rotated forward.
Figure 19:
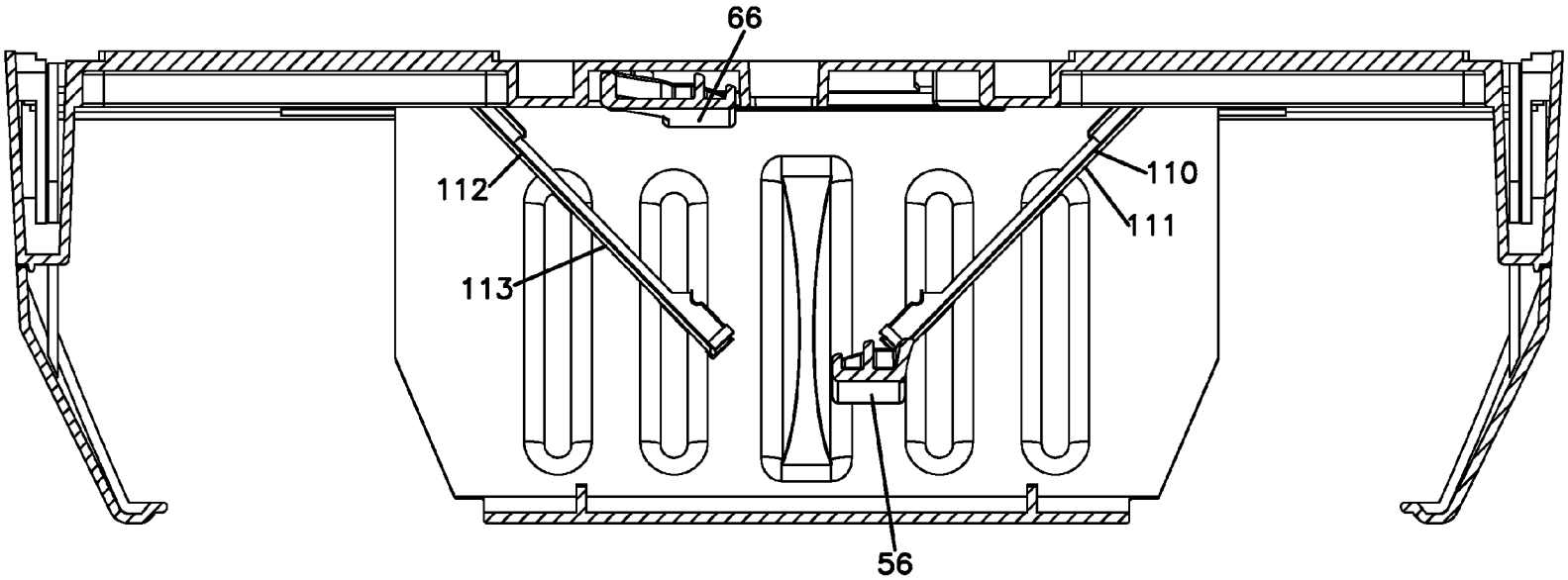
FIG. 19 is a sectional view similar to FIG. 17 except that the door has moved.
Figure 20:
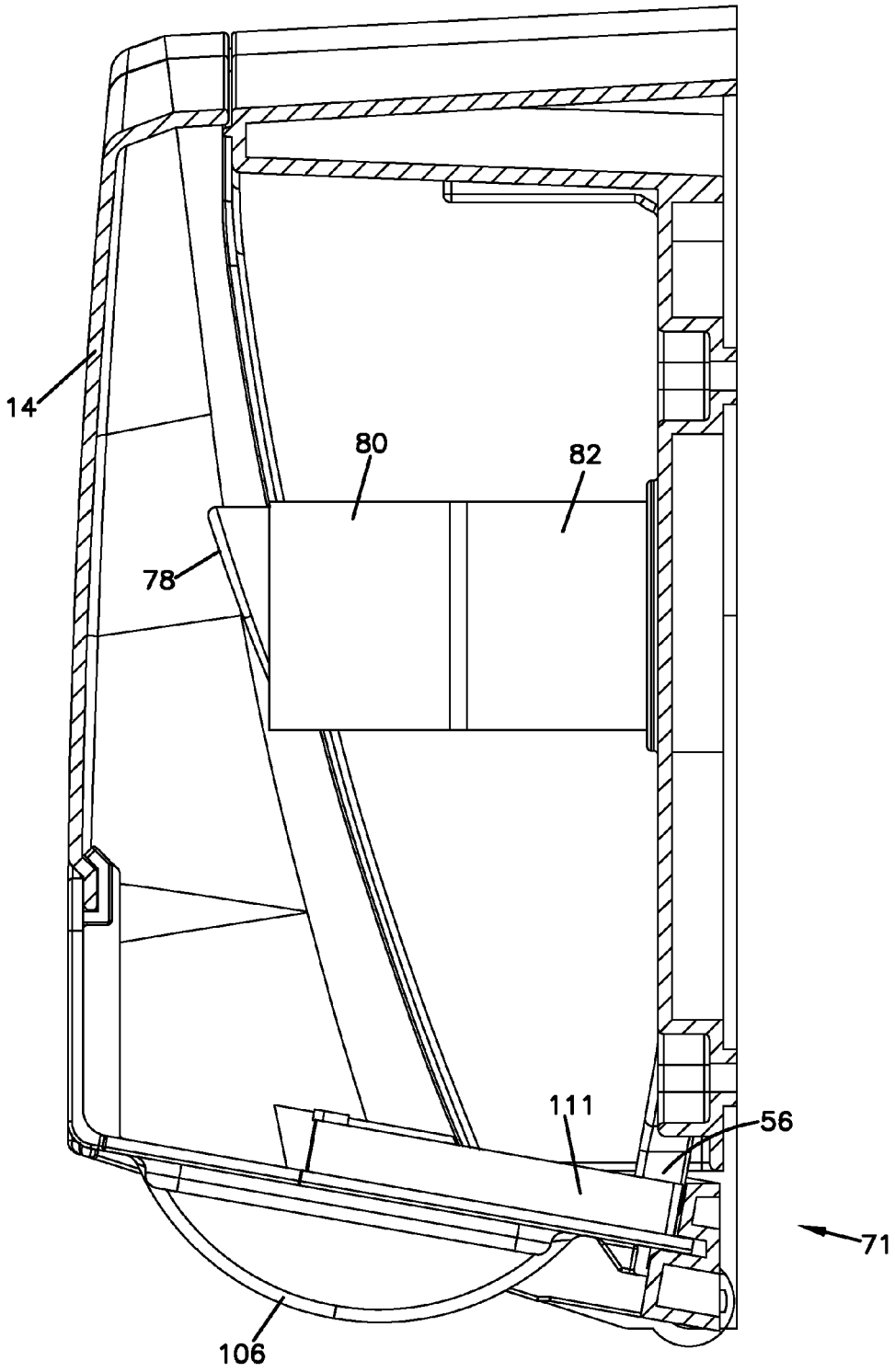
FIG. 20 is a sectional view of the dispenser of FIG. 12 except that the holder is returned to the dispensing location.
Figure 21:
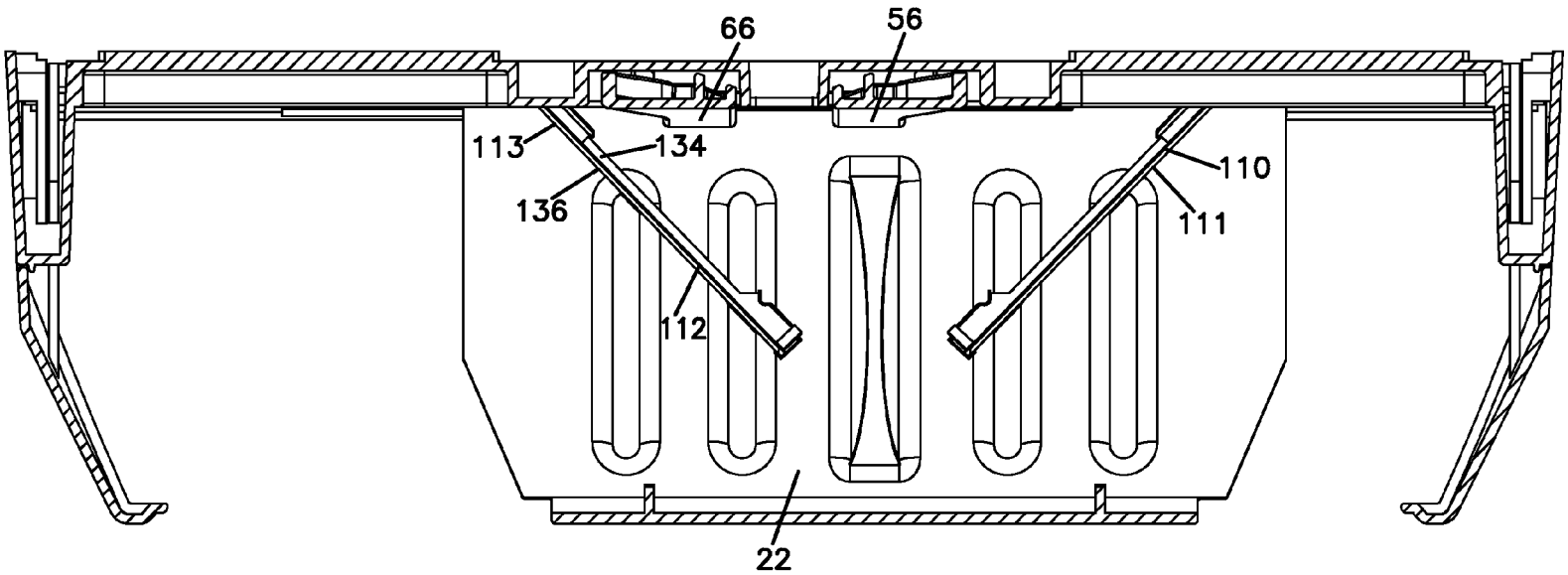
FIG. 21 is a sectional view similar to FIG. 19 except the door has moved.
Figure 22:
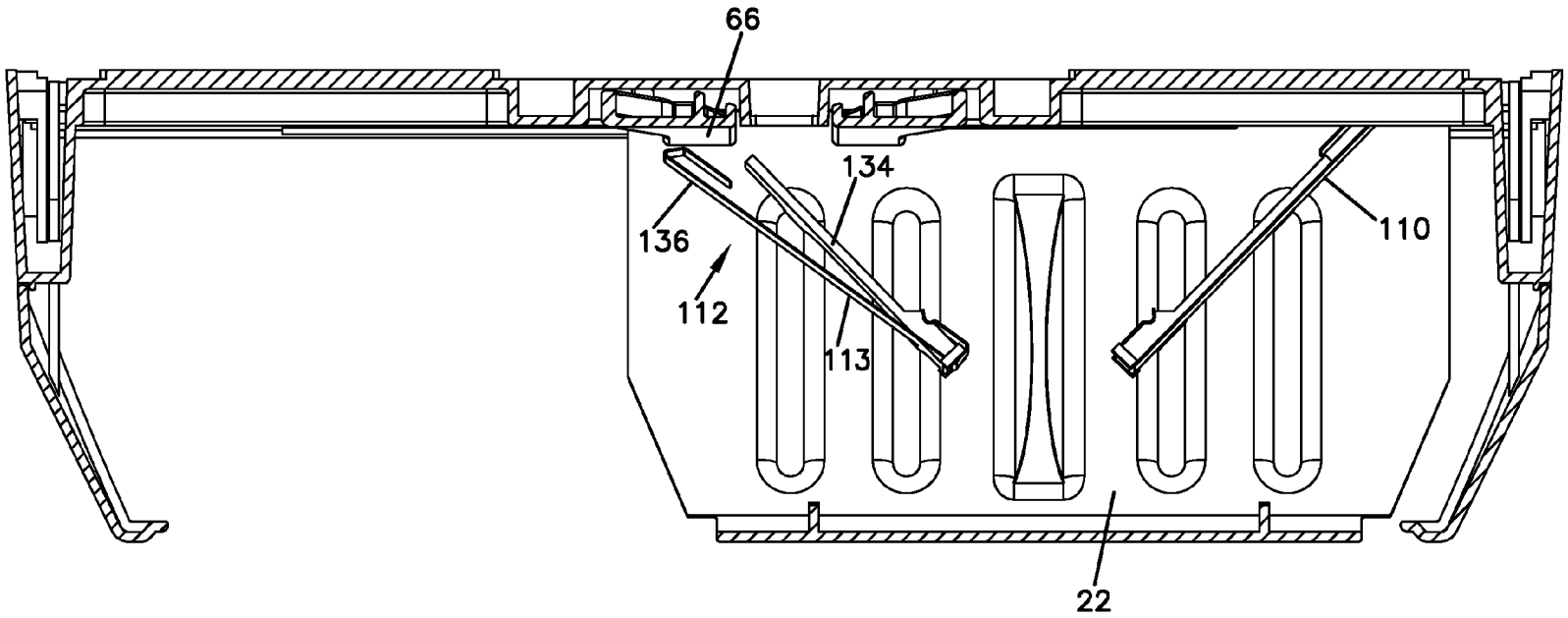
FIG. 22 is a sectional view similar to FIG. 21 except that the door has moved.

Now referring to FIGS. 12-22, the operation of this tissue dispenser 10 is illustrated. FIG. 12 is a front view of the tissue dispenser 10 wherein the door 22 is provided in the first position 24 so that tissue can be accessed from the tissue roll 18 through the opening 20. The sectional line indicators in FIG. 12 show where sections are taken at various stages illustrating the operation of the tissue dispenser 10. In FIG. 13, the door 22 is unable to slide to the right as a result of the first locking member 110 engaging the second end 56 of the first back panel 50. Tissue is located on both the first tissue roll 18 and the second tissue roll 19. Only tissue from the first tissue roll 18 is accessible through the opening 20 because the door 22 blocks access to the second tissue roll 19. Furthermore, the presence of tissue on the first tissue roll 18 prevents the first back panel 50 from rotating toward the unlocked or release position 70. FIG. 14 also illustrates a sectional view of the issue dispenser 10 shown in FIG. 12 where there is plenty of issue on the tissue roll 18. Now referring to FIG. 15, the tissue from the first tissue roll 18 has been exhausted leaving a first core section 80 and second core section 82. A user can grasp the handle 106 and slide the door from the first position 24 toward the second position 26. As this occurs, the first locking member 110 engages the second end 56 of the first back panel 50 causing the first back panel 50 to rotate forward along the slide surface 111 of the first locking member 110. As illustrated in FIGS. 16 and 17, the first end 56 slides along the slide surface 111 as the door 22 moves toward the second position 26. As further illustrated in FIG. 18, the slanted end 78 of the first mandrel 52 engages the cover 14 thereby causing the first core 80 to collapse onto the second core 82. FIG. 19 shows the progress of the door 22 corresponding to FIG. 18. The position of the first back panel 50 in FIG. 18 illustrates the unlocked or release position because the door 22 is allowed to continue sliding. In FIG. 20, the door 22 continues to move toward the second position 26, and the second end 56 is no longer sliding along the slide surface 111. As a result, the first back panel 50 is allowed to rotate back into the locked position 71. Now referring to FIG. 21, the door 22 continues to slide toward the second position 26. The second locking member 112 engages the second end 66. In particular, the transfer spring 136 is permitted to rotate in a counter clockwise direction thereby permitting the door 22 to continue sliding. Once the door 22 reaches the second position 26, the transfer spring 136 is beyond the second end 66 and can return to its normal position relative to the rib 134. As a result, the door 22 is now locked in the second position, and the tissue dispenser 10 permits dispensing of tissue from the second tissue roll 19 through the opening 20. The movement of the door from the second position 26 to the first position 24 mirrors the operation illustrated. Once the tissue on the second tissue roll 19 is exhausted, a user can grasp the handle 106 and move the door 22 toward the first position 24. As a result of that movement, the second locking member 112 engages the second end 66 of the second back panel 60 causing the second end 66 to slide along the slide surface 113 of the second locking member 112.

As illustrated and described, the door 22 is permitted to move between the first position 24 and the second position 26 only when the roll of tissue accessible through the opening has been exhausted. Once this has occurred and a new roll of tissue is available for the user. A custodian can service the tissue dispenser by moving the cover 14 into an open position 28, removing the remaining core, if present, and introducing a new tissue roll on the available mandrel. The custodian need not remove and replace the tissue roll that is currently being used. As a result, the tissue dispenser 10 encourages complete utilization of a tissue roll before allowing access to a new tissue roll.

The above specification provides a complete description of the device and its use according of the invention. Since many embodiments of the invention can be made without departing from the spirit and scope of the invention, the invention resides in the claims hereinafter appended.

What is claimed is:

1. A tissue dispenser comprising:

(a) a housing and cover that attach together and form an interior region for holding multiple tissue rolls and a dispenser opening for dispensing tissue from the dispenser interior;

(b) a first roll holder located within the interior region, the first roll holder comprising a first back panel and a first mandrel extending from the first back panel, the first back panel is constructed to rotate, relative to the housing, between a locked position and an unlocked position, and the first mandrel is constructed to receive a first tissue roll;

(c) a second roll holder located within the interior region, the second roll holder comprising a second back panel and second mandrel extending from the second back panel, the second back panel is constructed to rotate relative to the housing, between a locked position and an unlocked position, and the second mandrel is constructed to receive a second tissue roll;

(d) a door constructed to move within the dispenser opening between a first position and a second position so that when the door is provided in the first position, tissue can be dispensed from the first tissue roll provided on the first mandrel, and when the door is provided in the second position, tissue can be dispensed from the second tissue roll positioned on the second mandrel, wherein the door is constructed so that when the door is provided in either the first position or the second position and tissue is dispensing from either the first roll or the second roll, the door is unable to move to the other of the first position or the second position until the tissue being dispensed is exhausted; and (e) wherein the tissue dispenser is constructed so that when the door is in the first osition and the first back anel is in the locked osition the movement of the first back anel from the locked position to the unlocked position permits the door to move from the first sosition to the second position.

2. A tissue dispenser according to claim 1, wherein the cover is constructed to move between a closed position and an open position so that the tissue dispenser is available for dispensing tissue when the cover is in a closed position, and the tissue dispenser can be serviced when the cover is in an open position.

3. A tissue dispenser according to claim 2, wherein the cover is rotatably attached to the housing so that the cover rotates between the closed position and the open position.

4. A tissue dispenser according to claim 1, wherein the dispenser opening is provided as part of the cover.

5. A tissue dispenser according to claim 1, wherein the door engages either of the first roll holder or the second roll holder provided in a locked position that prevents the door from moving from the first position or the second position to the other of the first position or the second position.

6. A tissue dispenser according to claim 1, wherein the door comprises a first locking member constructed to engage the first roll holder, and a second locking member constructed to engage the second roll holder.

7. A tissue dispenser according to claim 6, wherein the first locking member comprises a slide surface along which the first roll holder is permitted to slide.

8. A tissue dispenser according to claim 6, wherein the second locking member comprises a slide surface along which the second roll holder is permitted to slide.

9. A tissue dispenser according to claim 1, further comprising:

(a) a first tissue roll located on the first mandrel; and (b) a second tissue roll located on the second mandrel.

10. A tissue dispenser according to claim 9, wherein the first tissue roll and the second tissue roll comprise reduced core tissue rolls having first and second core sections that are spaced a part from each other.

11. A tissue dispenser according to claim 1, wherein the first mandrel extends perpendicular to the first back panel, and the second mandrel extends perpendicular to the second back panel.

12. A tissue dispenser according to claim 1, wherein the housing comprises a back wall for mounting on a vertical wall.

13. A tissue dispenser according to claim 12, wherein the back wall comprises a first recess and a second recess wherein the first recess is constructed to receive the first back panel and the second recess is constructed to receive the second back panel.

14. A tissue dispenser according to claim 1, wherein the tissue dispenser is constructed so that, when the door is in the second position and the second back panel is in the locked position, the movement of the second back panel from the locked position to the unlocked position permits the door to move from the second position to the first position.

15. A tissue dispenser according to claim 1, wherein the door comprises a first locking member that engages the first back panel when the first back panel is provided in the locked position and the door is provided in the first position thereby preventing movement of the door from the first position to the second position until the tissue on the first mandrel is exhausted.

16. A tissue dispenser according to claim 1, wherein the door comprises a second locking member that engages the second back panel when the second back panel is provided in the locked position and the door is provided in the second position thereby preventing movement of the door from the second position to the first position until the tissue on the second mandrel is exhausted.

17. A method for dispensing tissue comprising steps of:

(a) depleting tissue from a first tissue roll located in a tissue dispenser, the tissue dispenser comprising:

(i) a housing and cover that attach together and form an interior region for holding the first tissue roll and for holding at least a second tissue roll, and a dispenser opening for dispensing tissue from the dispenser interior;

(ii) a first roll holder located within the interior region, the first roll holder comprising a first back panel and a first mandrel extending from the first back panel, the first back panel is constructed to rotate, relative to the housing, between a locked position and an unlocked position, and the first tissue roll located on the first mandrel;

(iii) a second roll holder located within the interior region, the second roll holder comprising a second back panel and second mandrel extending from the second back panel, the second back panel is constructed to rotate relative to the housing, between a locked position and an unlocked position, and the second tissue roll located on the second mandrel; and (iv) a door constructed to move within the dispenser opening between a first position and a second position so that when the door is provided in the first position, tissue can be dispensed from the first tissue roll provided on the first mandrel, and when the door is provided in the second position, tissue can be dispensed from the second tissue roll positioned on the second mandrel, wherein the door is constructed so that when the door is provided in either the first position or the second position and tissue is dispensing from either the first roll or the second roll, then the door is unable to move to the other of the first position or the second position until the tissue being dispensed is exhausted; and (b) moving the door from the first position to the second position in order to access tissue from the second tissue roll, and wherein the step of moving the door from first position to the second position causes the first back panel to move from the locked position to the unlocked position.

18. A method according to claim 17, further comprising:

(a) moving the cover to an open position for accessing the dispenser interior, and placing a new tissue roll on the first mandrel.

19. A method according to claim 17, further comprising:

(a) depleting tissue from the second tissue roll located in the tissue dispenser; and (b) moving the door from the second position to the first position in order to access the tissue from the first tissue roll, and wherein the step of moving the door from the second position to the first position causes the second back panel to move from the locked position to the unlocked position.

20. A method according to claim 19, wherein the step of moving the door from the second position to the first position comprises causing a second locking member on the door to engage the second back panel and cause the second back panel to rotate from the locked position to the unlocked position.

21. A method according to claim 17, wherein the step of moving the door from the first position to the second position comprises causing a first locking member on the door to engage the first back panel and cause the first back panel to rotate from the locked position to the unlocked position.

* * * * *